US010845757B2

(12) United States Patent
Kawashima et al.

(10) Patent No.: US 10,845,757 B2
(45) **Date of Patent: *Nov. 24, 2020**

(54) IMAGE PROCESSING APPARATUS HAVING COOLING DUCT

(71) Applicant: TOSHIBA TEC KABUSHIKI KAISHA, Tokyo (JP)

(72) Inventors: Yuki Kawashima, Tagata Shizuoka (JP); Masaya Tanaka, Sunto Shizuoka (JP); Shuji Yokoyama, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/796,512

(22) Filed: Feb. 20, 2020

(65) Prior Publication Data

US 2020/0301327 A1 Sep. 24, 2020

Related U.S. Application Data

(63) Continuation-in-part of application No. 16/358,940, filed on Mar. 20, 2019.

(51) Int. Cl.
*G03G 15/20* (2006.01)
*G03G 21/20* (2006.01)

(52) U.S. Cl.
CPC ..... *G03G 21/206* (2013.01); *G03G 15/2017* (2013.01); *G03G 15/2021* (2013.01); *G03G 15/2042* (2013.01); *G03G 2221/1645* (2013.01)

(58) Field of Classification Search
CPC ..... G03G 15/2017; G03G 21/206; G03G 2221/1645
See application file for complete search history.

(56) References Cited

U.S. PATENT DOCUMENTS 9,383,692 B2 * 7/2016 Ueno ..... G03G 15/2017
10,466,630 B2 11/2019 Ando
2012/0282002 A1 * 11/2012 Murasaki ..... G03G 15/2017 399/329

FOREIGN PATENT DOCUMENTS

JP 2008052031 A * 3/2008
JP 2018-060106 A 4/2018

OTHER PUBLICATIONS

Kawasumi, JP 2008-052031 A, Mar. 2008, JPO Computer Translation (Year: 2008).*

* cited by examiner

*Primary Examiner* — Erika J Villaluna
(74) *Attorney, Agent, or Firm* — Kim & Stewart LLP

(57) ABSTRACT

An image processing apparatus includes a heating device a temperature sensor, and a controller. The heating device includes a rotator, a fan, an introduction duct, a cooling duct, and a movement mechanism. The introduction duct is shaped such that an airflow generated by the fan is directed towards and is incident on a first end portion of the rotator. The cooling duct extends between the introduction duct and a first end of the rotator, and faces the first end portion. The cooling duct includes a plurality of duct portions. The movement mechanism is configured to move the fan, the introduction duct, and at least one of the duct portions along the rotational axis. The temperature sensor is configured to detect a temperature at the first end portion. The controller is configured to control a movement of the movement mechanism based on a temperature detected by the temperature sensor.

20 Claims, 12 Drawing Sheets

IMAGE PROCESSING APPARATUS HAVING COOLING DUCT

CROSS-REFERENCE TO RELATED APPLICATION

This application is a Continuation-in-Part of U.S. non-Provisional patent application Ser. No. 16/358,940, filed on Mar. 20, 2019, the entire contents of each of which are incorporated herein by reference.

FIELD

Embodiments described herein relate generally to a heating device and an image processing apparatus.

BACKGROUND

Image processing apparatuses such as image forming apparatuses include heating devices such as fixing devices. The fixing devices heat and pressurize toner images transferred to paper to fix the toner images to the paper. Sheet passing regions of the fixing devices are heated at predetermined fixing temperatures. On the other hand, temperatures of sheet non-passing regions of the fixing devices may become high because heat is not transferred to the paper. Heating devices capable of efficiently cooling sheet non-passing regions are desirable.

DETAILED DESCRIPTION

In general, according to an embodiment, an image processing apparatus includes an image forming device, a heating device a temperature sensor, and a controller. The heating device is configured to fix a toner image formed on a sheet by the image forming device. The heating device includes a rotator, a fan, an introduction duct, a cooling duct, and a movement mechanism. The rotator has, inside thereof, a heater configured to generate heat for fixing the toner image. The fan is configured to generate an airflow towards a surface of the rotator. The introduction duct is positioned with respect to the fan and shaped such that the airflow generated by the fan is directed towards and is incident on a first end portion of the rotator in an axial direction of the rotator. The cooling duct extends between the introduction duct and a first end of the rotator in the axial direction, and faces the first end portion of the rotator. The cooling duct includes a plurality of duct portions extending along the rotational axis of the rotator. The movement mechanism is configured to move the fan, the introduction duct, and at least one of the duct portions of the cooling duct along the rotational axis of the rotator. The temperature sensor is configured to detect a temperature at the first end portion of the rotator. The controller is configured to control a movement of the movement mechanism based on a temperature detected by the temperature sensor.

Hereinafter, a heating device and an image processing apparatus according to an embodiment will be described with reference to the drawings.

First Embodiment

Figure 1:
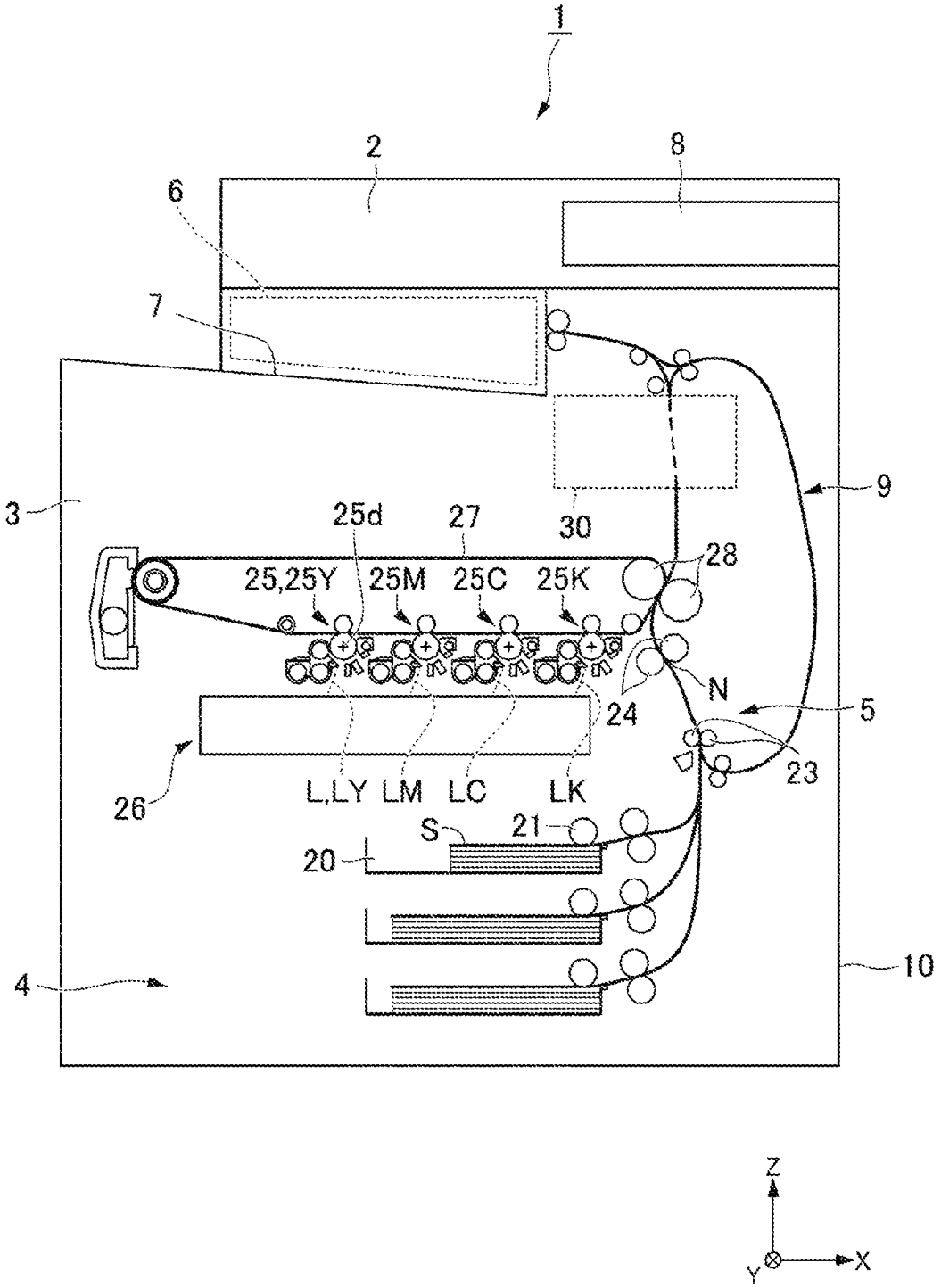
FIG. 1 is a schematic diagram illustrating a configuration of an image processing apparatus according to a first embodiment.

FIG. 1 is a schematic diagram illustrating a configuration of an image processing apparatus according to a first embodiment.

The image processing apparatus according to the first embodiment is an image forming apparatus 1. The image forming apparatus 1 performs a process of forming an image on a sheet (paper) S.

The image forming apparatus 1 includes a housing 10, a scanner unit 2, an image forming unit 3, a sheet supply unit 4, a transport unit 5, a discharge tray 7, a reversing unit 9, a control panel 8, and a control unit 6.

The housing 10 forms the outer shape of the image forming apparatus 1.

The scanner unit 2 obtains image information of a copy target based on brightness and darkness of light to generate an image signal. The scanner unit 2 outputs the generated image signal to the image forming unit 3.

The image forming unit 3 forms an output image (hereinafter referred to as a toner image) using a recording agent such as toner based on the image signal received from the scanner unit 2 or an image signal received from the outside. The image forming unit 3 transfers the toner image to the surface of the sheet S. The image forming unit 3 heats and pressurizes the toner image on the surface of the sheet S to fix the toner image to the sheet S. The details of the image forming unit 3 will be described below.

The sheet supply unit 4 supplies the sheets S to the transport unit 5 one by one at a timing at which the image forming unit 3 forms the toner image. The sheet supply unit 4 includes a sheet accommodation unit 20 and a pickup roller 21.

The sheet accommodation unit 20 accommodates a predetermined kind of sheet S of a predetermined size.

The pickup roller 21 picks up the sheets S one by one from the sheet accommodation unit 20. The pickup roller 21 supplies the picked-up sheet S to the transport unit 5.

The transport unit 5 transports the sheet S supplied from the sheet supply unit 4 to the image forming unit 3. The transport unit 5 includes transport rollers 23 and the register rollers 24.

The transport rollers 23 transport the sheet S supplied from the pickup roller 21 to the register rollers 24. The transport rollers 23 butts a leading end of the sheet S in a transport direction to a nip N of the register rollers 24. The register rollers 24 arrange the position of the leading end of the sheet S in the transport direction by curving the sheet S at the nip N. The register rollers 24 transport the sheet S at a timing at which the image forming unit 3 transfers the toner image to the sheet S.

The image forming unit 3 will be described below.

The image forming unit 3 includes a plurality of image forming sections 25, a laser scanning unit 26, an intermediate transfer belt 27, a transfer unit 28, and a fixing device 30.

The image forming section 25 includes a photoconductive drum 25*d*. The image forming section 25 forms the toner image in accordance with an image signal from the scanner unit 2 or the outside on the photoconductive drum 25*d*. The plurality of image forming sections 25Y, 25M, 25C, and 25K form toner images using yellow, magenta, cyan, and black toner, respectively.

A charging unit, a developing unit, and the like are disposed around the photoconductive drum 25*d*. The charging unit charges the surface of the photoconductive drum 25*d*. The developing unit accommodates a developer including yellow, magenta, cyan, and black toner. The developing unit develops an electrostatic latent image on the photoconductive drum 25*d*. Then, the toner image is formed using the toner of each color on the photoconductive drum 25*d*.

The laser scanning unit 26 scans the charged photoconductive drum 25*d* with a laser beam L to expose the photoconductive drum 25*d*. The laser scanning unit 26 exposes the photoconductive drums 25*d* of the image forming sections 25Y, 25M, 25C, and 25K of each color to laser beams LY, LM, LC, and LK of each light ray. In this manner, the laser scanning unit 26 forms the electrostatic latent images on the photoconductive drums 25*d*.

The toner image on the surface of the photoconductive drums 25*d* is primarily transferred to the intermediate transfer belt 27.

The transfer unit 28 transfers the toner image primarily transferred onto the intermediate transfer belt 27 onto the surface of the sheet S at a secondary transfer position.

The fixing device 30 heats and pressurizes the toner images transferred to the sheet S to fix the toner images to the sheet S. The details of the fixing device 30 will be described below.

The reversing unit 9 reverses the sheet S to form an image on the back surface of the sheet S. The reversing unit 9 reverses the front and back of the sheet S discharged from the fixing device 30 by switch back. The reversing unit 9 transports the reversed sheet S toward the register rollers 24.

The discharge tray 7 loads the sheet S discharged after the image is formed.

The control panel 8 is a part of an input unit with which information for an operator to operate the image forming apparatus 1 is input. The control panel 8 includes a touch panel and various hard keys.

The control unit 6 controls each unit of the image forming apparatus 1. The details of the control unit 6 will be described below.

Figure 2:
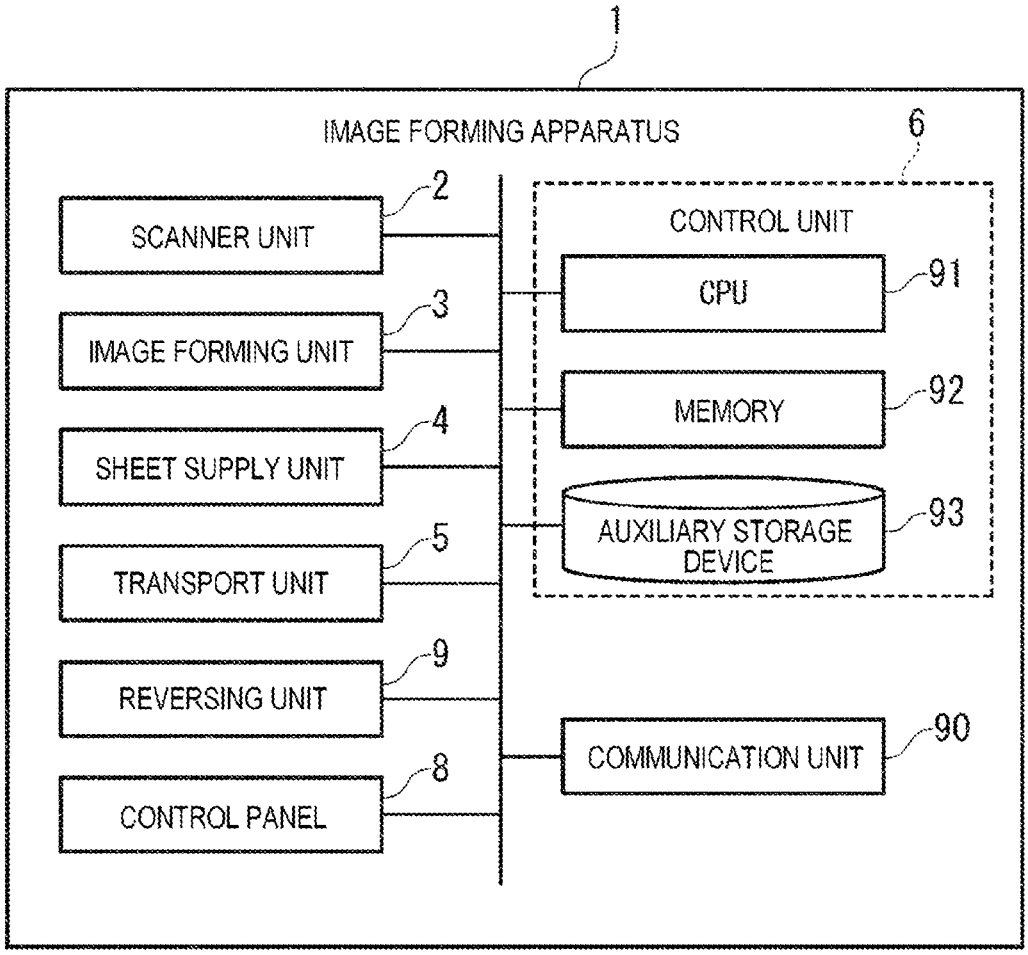
FIG. 2 is a diagram illustrating a functional configuration of the image processing apparatus according to the first embodiment.

FIG. 2 is a diagram illustrating a functional configuration of the image processing apparatus according to the first embodiment. The image forming apparatus 1 includes a central processing unit (CPU) 91, a memory 92, and an auxiliary storage device 93 connected via a bus and executes a program. The image forming apparatus 1 functions as an apparatus that includes the scanner unit 2, the image forming unit 3, the sheet supply unit 4, the transport unit 5, the reversing unit 9, the control panel 8, and a communication unit 90 by executing the program.

The CPU 91 functions as the control unit 6 by executing a program stored in the memory 92 and the auxiliary storage device 93. The control unit 6 controls an operation of each functional unit of the image forming apparatus 1.

The auxiliary storage device 93 is configured as a storage device such as a magnetic hard disk device or a semiconductor storage device. The auxiliary storage device 93 stores information.

The communication unit 90 includes a communication interface for connecting the image forming apparatus to an external apparatus. The communication unit 90 communicates with an external apparatus via a communication interface.

The fixing device 30 will be described below.

Figure 3:
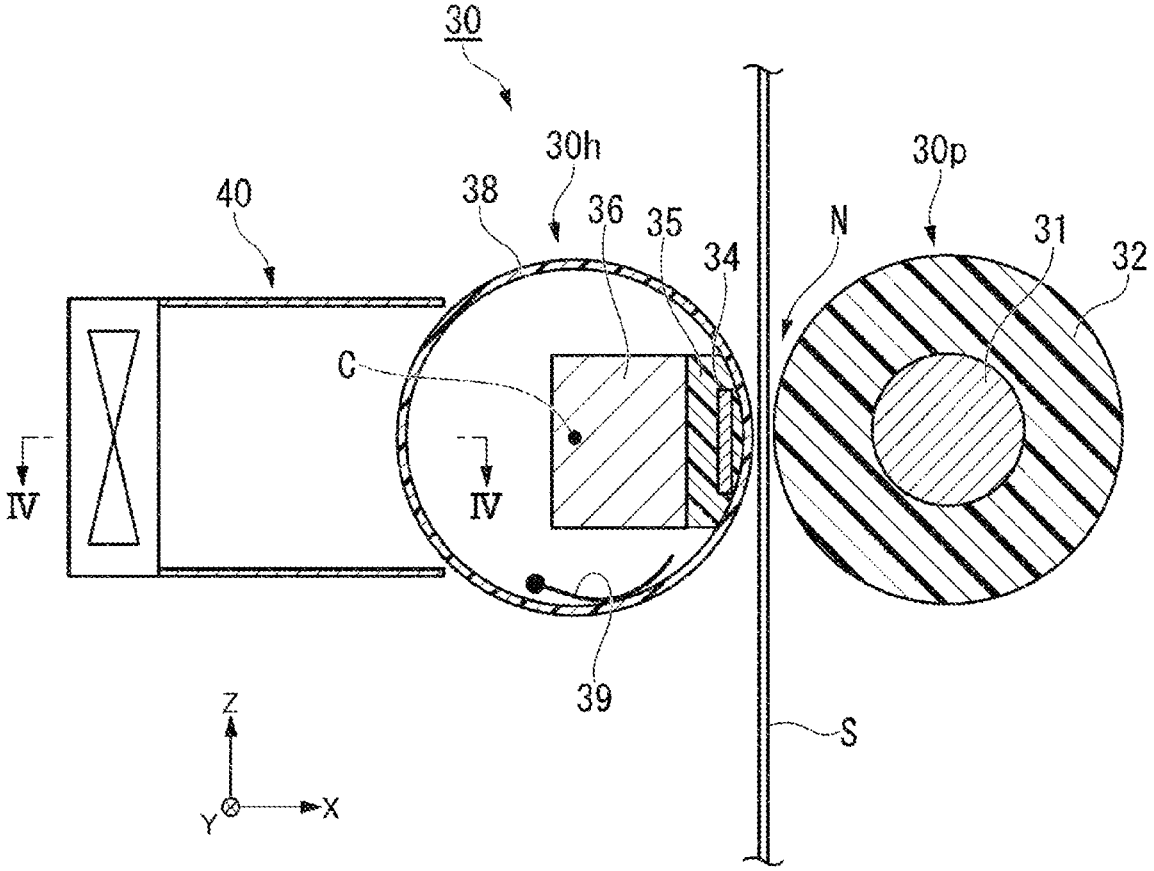
FIG. 3 illustrates a front cross-sectional view of a heating device according to the first embodiment.

FIG. 3 illustrates a front cross-sectional view of a heating device according to the first embodiment. FIG. 3 illustrates a cross-sectional view of a portion of the heating device taken along the line III-III of FIG. 4. The heating device according to the first embodiment is the fixing device 30 of a thermal print-head type. The fixing device 30 includes a pressure roller 30*p*, a heating roller 30*h*, and a cooling device 40.

The pressure roller 30*p* can come into contact with the heating roller 30*h* and can be separated from the heating roller 30*h*. The pressure roller 30*p* includes an axial member 31 and a surface layer member 32.

The axial member 31 is formed of a metal material or the like. The axial member 31 is rotatably driven by a motor (not illustrated).

The surface layer member 32 is formed of a rubber material or the like. The outermost circumference of the surface layer member 32 is coated with a surface protection layer such as PFA.

The heating roller 30*h* is disposed side by side with the pressure roller 30*p*. The heating roller 30*h* includes a heater (heat source) 34, a heater holding member 35, a support member 36, a fixing belt (rotator) 38, and a temperature sensor 39. The heater 34, the heater holding member 35, and the support member 36 stretch in a direction of a rotation axis C of the fixing belt 38 and are disposed inside the fixing belt 38.

The heater 34 is formed by stacking heating resistance layers on a substrate. The substrate is formed of a ceramic material or the like. The heating resistance layer is formed of a material generating heat by conduction. A protective layer is formed on the surface of the heater 34 which is in contact with the fixing belt 38. The heater 34 is disposed inside the fixing belt 38 at a position closest to the pressure roller 30*p*.

The heater holding member 35 is formed of a resin material with a thermal resisting property or the like. The heater holding member 35 is disposed on a side opposite to the pressure roller 30*p* with the heater 34 therebetween to hold the heater 34.

The support member 36 is formed of a metal material or the like. The support member 36 is disposed on a side opposite to the pressure roller 30*p* with the heater holding member 35 therebetween. Both ends of the support member 36 in the longitudinal direction extend outwards from both ends of the fixing belt 38 in the direction of the rotation axis C. Both ends of the support member 36 are fixed to the housing 10 of the image forming apparatus 1. In this manner, the support member 36 supports the constituent members of the heating roller 30*h*.

The fixing belt 38 is a cylindrical endless belt. The fixing belt 38 is formed by stacking a base layer, an elastic layer, and a surface release layer from the inner circumference side to the outer circumference side. The base layer is formed of a metal material or the like. The elastic layer is formed of a rubber material or the like. The surface release layer is formed of PFA or the like. The fixing belt 38 may be a film-like member.

The temperature sensor 39 comes into contact with the inner circumferential surface of the fixing belt 38. The temperature sensor 39 is used to detect temperature of the fixing belt 38. The temperature sensor 39 outputs a signal corresponding to the temperature of the fixing belt 38 to the control unit 6.

When the pressure roller 30*p* comes into contact with the heating roller 30*h*, the nip N is formed between the pressure roller 30*p* and the fixing belt 38. When the pressure roller 30*p* is rotatably driven, the fixing belt 38 is driven to rotate about the rotation axis C by a frictional force. When the sheet S is passed through the nip N, the toner images transferred to the sheet S are heated and pressurized. Thus, the fixing device 30 fixes the toner images to the sheet S. Since the heater 34 is disposed inside the fixing belt 38 in the nip N, the heater 34 substantially forms the nip N. When the heater 34 heats the sheet S while forming the nip N, the fixing device 30 with good responsiveness at the time of conduction is formed.

Figure 4:
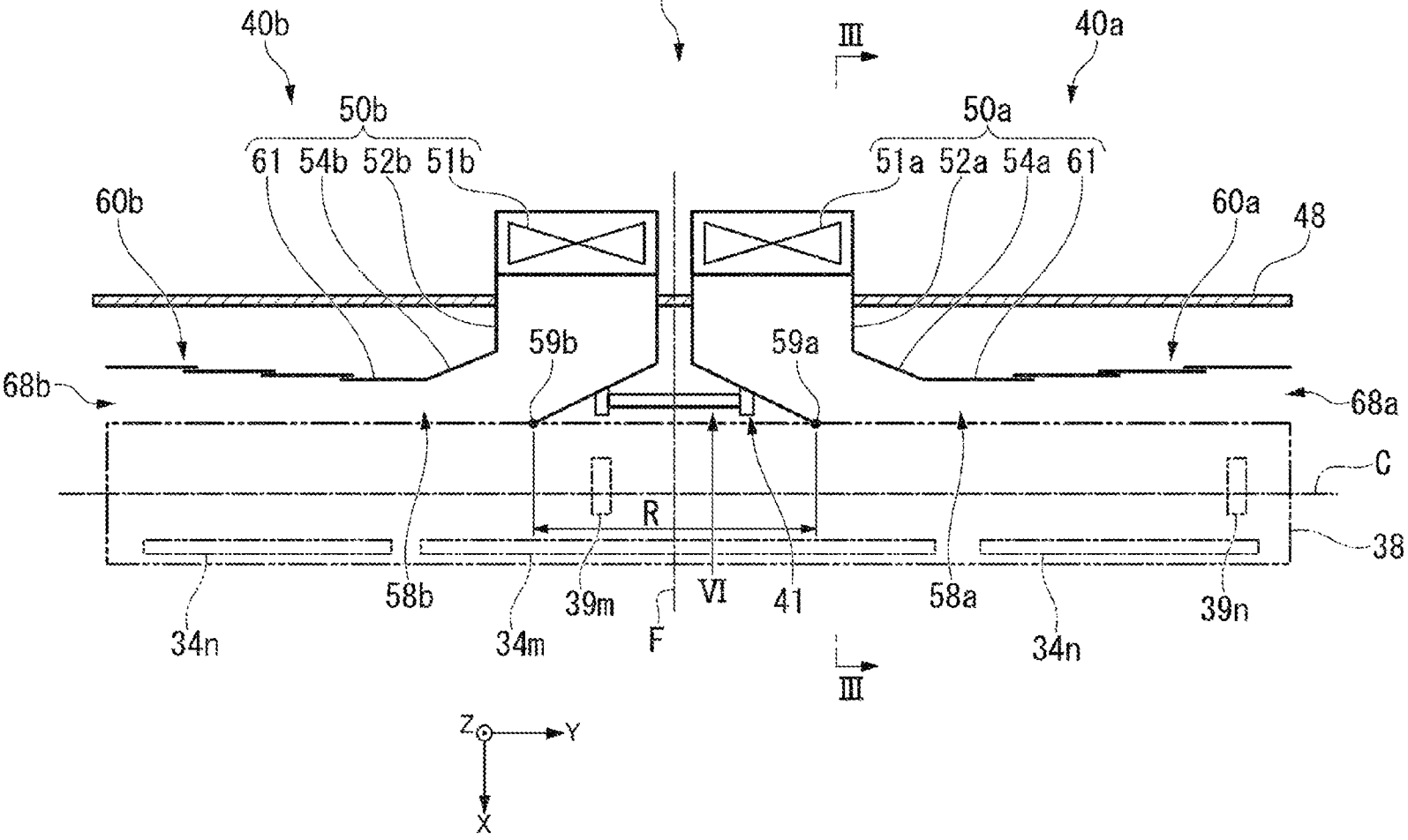
FIG. 4 illustrates a cross-sectional view of a cooling device including a first cooling device and a second cooling device.

As illustrated in FIG. 4, the heater 34 includes a middle heater 34*m* and end heaters 34*n*. The middle heater 34*m* is disposed in the middle of the fixing belt 38 in the direction of the rotation axis C. The end heaters 34*n* are disposed at both ends of the fixing belt 38 in the direction of the rotation axis C. The temperature sensor 39 includes a middle temperature sensor 39*m* and an end temperature sensor 39*n*. The middle temperature sensor 39*m* is used to detect temperature of the fixing belt 38 in the middle of the fixing belt 38 in the direction of the rotation axis C. The end temperature sensor 39*n* is used to detect temperature of the fixing belt 38 at the end of the fixing belt 38 in the direction of the rotation axis C. The control unit 6 controls conduction to the heater 34 based on the temperature detected by the middle temperature sensor 39*m* and maintains the temperature of the fixing belt 38 at a predetermined temperature. The control unit 6 controls running of the cooling device 40 based on the temperature detected by the end temperature sensor 39*n*.

The cooling device 40 will be described.

FIG. 4 illustrates a cross-sectional view of the cooling device taken along the line IV-IV of FIG. 3.

In the present specification, an X direction, a Y direction, and a Z direction are defined as follows. The X direction is a direction in which the cooling device 40 and the fixing belt 38 which is a cooling target are arranged. A +X direction is a direction oriented from the cooling device 40 to the fixing belt 38. The Y direction (a rotation axis direction) is a direction of the rotation axis C of the fixing belt 38. A +Y direction (a first direction) is a direction oriented from the left end (a second end) of the fixing belt 38 to the right end (a first end) of the fixing belt 38 in FIG. 4. A −Y direction (a second direction) is a direction opposite to the +Y direction. The Z direction is a direction orthogonal to the X direction and the Y direction.

The cooling device 40 includes a first cooling device 40*a*, a second cooling device 40*b*, and a movement mechanism 41.

Figure 5:
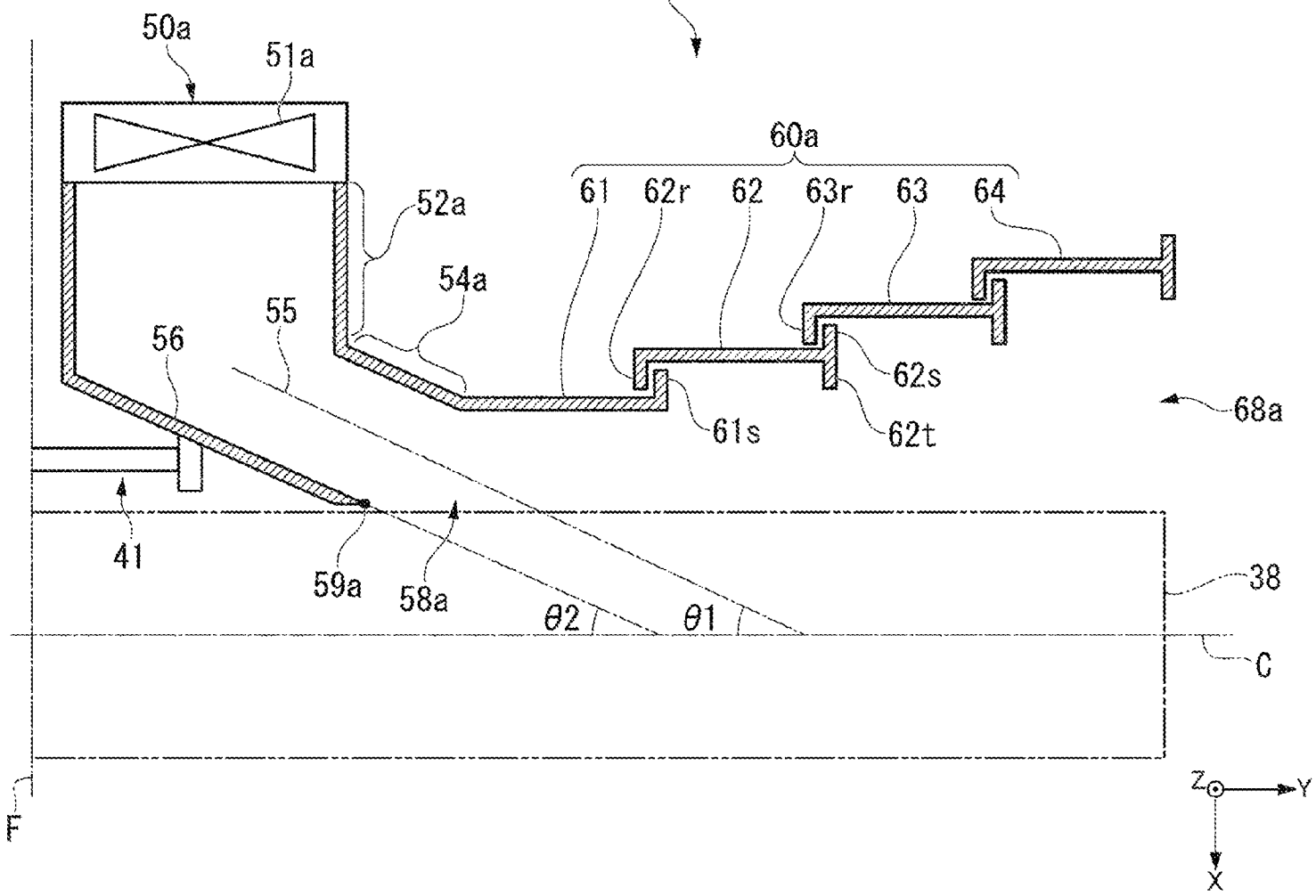
FIG. 5 illustrates a cross-sectional view of a first cooling device.

FIG. 5 illustrates a cross-sectional view of the first cooling device.

The first cooling device 40*a* includes a first fan 51*a*, a first connection duct 52*a*, a first introduction duct 54*a*, and a first cooling duct 60*a*.

The first fan 51*a* generates a first cooling wind for cooling the fixing belt 38. The first fan 51*a* is disposed so that the first cooling wind is directed in the +X direction.

The first connection duct 52*a* is disposed downstream from the first fan 51*a* in a circulation direction of the first cooling wind (hereinafter simply referred to as a downstream side). The first connection duct 52*a* is connected in the +X direction of the first fan 51*a*. The cross-sectional shape orthogonal to a passage center axis of the first connection duct 52*a* is rectangular. The passage center axis of the first connection duct 52*a* is disposed in parallel to the X direction. The first connection duct 52*a* connects the first fan 51*a* to the first introduction duct 54*a*.

The first introduction duct 54*a* is disposed downstream from the first connection duct 52*a*. The cross-sectional shape orthogonal to a passage center axis 55 of the first introduction duct 54*a* is rectangular. The first introduction duct 54*a* stretches in the +Y direction as approaching the rotation axis C of the fixing belt 38 (being oriented in the +X direction). The first introduction duct 54*a* stretches in the +X direction and the +Y direction from the end of the first connection duct 52*a* in the +X direction. An angle of the first introduction duct 54*a* with respect to the −Y direction of the passage center axis 55 is θ1. An angle of the −Y direction of the first introduction duct 54*a* with respect to the −Y direction of a wall surface 56 is θ2. The angles θ1 and θ2 are less than 90 degrees. The angles θ1 and θ2 are preferably equal to or less than 40 degrees.

The first cooling duct 60*a* is disposed downstream from the first introduction duct 54*a*. The cross-sectional shape orthogonal to the passage center axis of the first cooling duct 60*a* is a U shape open in the +X direction. The first cooling duct 60*a* stretches in the +Y direction along the outer circumferential surface of the fixing belt 38 from the ends of the first introduction duct 54*a* in the +X direction and the +Y direction. A first exhaust port 68*a* is open at the front end of the first cooling duct 60*a* in the +Y direction. The position of the first exhaust port 68*a* in the Y direction is the same as the position of the end of the fixing belt 38 in the +Y direction. A first cooling port 58*a* of the first cooling duct 60*a* is open along the outer circumferential surface of the fixing belt 38.

The first cooling duct 60*a* is formed by combining a plurality of partial ducts 61, 62, 63, and 64 in the Y direction. The outer shapes of the plurality of partial ducts 61 to 64 on the XZ cross sections increase in the +Y direction. The plurality of partial ducts 61 to 64 can overlap each other when viewed in the X direction and the Z direction. A relative position of the partial duct 64 disposed at the front end in the +Y direction with respect to the fixing belt 38 in the Y direction is fixed. The other partial ducts 61 to 63 can be moved in the Y direction. Thus, the first cooling duct 60*a* is formed to be expandable and contractible in the Y direction.

A first stopper 62*r* is provided at the end of the partial duct 62 in the −Y direction. The first stopper 62*r* protrudes from the end of the partial duct 62 in the −Y direction to the inside of the partial duct 62. A second stopper 62*s* and a third stopper 62*t* are provided at the end of the partial duct 62 in the +Y direction. The second stopper 62*s* protrudes from the end of the partial duct 62 in the +Y direction to the outside of the partial duct 62. The third stopper 62*t* protrudes from the end of the partial duct 62 in the +Y direction to the inside of the partial duct 62. The same applies to the other partial ducts 61, 63, and 64.

When the first cooling duct 60*a* stretches in the Y direction, the first stopper 62*r* of the partial duct 62 comes into contact with the second stopper 61*s* of the partial duct 61. In addition, the second stopper 62*s* of the partial duct 62 comes into contact with the first stopper 63*r* of the partial duct 63. The same applies to the other partial ducts 61, 63, and 64. Thus, when the first cooling duct 60*a* stretches in the Y direction, separation of the plurality of partial ducts 61 to 64 is prevented. In addition, the upper limit of an expansion and contraction range of the first cooling duct 60*a* is regulated. Leakage of the first cooling wind from connection portions of the plurality of partial ducts 61 to 64 is suppressed.

When the first cooling duct 60*a* contacts in the Y direction, the third stopper 62*t* of the partial duct 62 comes into contact with the second stopper 61*s* of the partial duct 61. The same applies to the other partial ducts 61, 63, and 64. Thus, the lower limit of the expansion and contraction range of the first cooling duct 60*a* is regulated. Leakage of the first cooling wind from connection portions of the plurality of partial ducts 61 to 64 is suppressed.

The first connection duct 52*a*, the first introduction duct 54*a*, and the partial duct 61 of the first cooling duct 60*a* are integrally formed. These members may be connected after the members are separately formed. The first fan 51*a*, the first connection duct 52*a*, the first introduction duct 54*a*, and the partial duct 61 of the first cooling duct 60*a* can be moved in the Y direction. These members form a first movement portion 50*a*.

As illustrated in FIG. 4, the first cooling device 40*a* and the second cooling device 40*b* are formed to be plane-symmetric with respect to a plane (the XZ plane) F which is orthogonal to the rotation axis C of the fixing belt 38 and passes through the center of the fixing belt 38 in the Y direction. The first cooling device 40*a* is disposed in the +Y direction of a symmetric plane F. The second cooling device 40*b* is disposed in the −Y direction of the symmetric plane F.

The second cooling device 40*b* includes a second fan 51*b*, a second connection duct 52*b*, a second introduction duct 54*b*, and a second cooling duct 60*b*. The configuration of these members is the same as that of the first cooling device 40*a*. The second fan 51*b*, the second connection duct 52*b*, the second introduction duct 54*b*, and the partial duct 61 of the second cooling duct 60*b* can be moved in the Y direction. These members form a second movement portion 50*b*.

Figure 6:
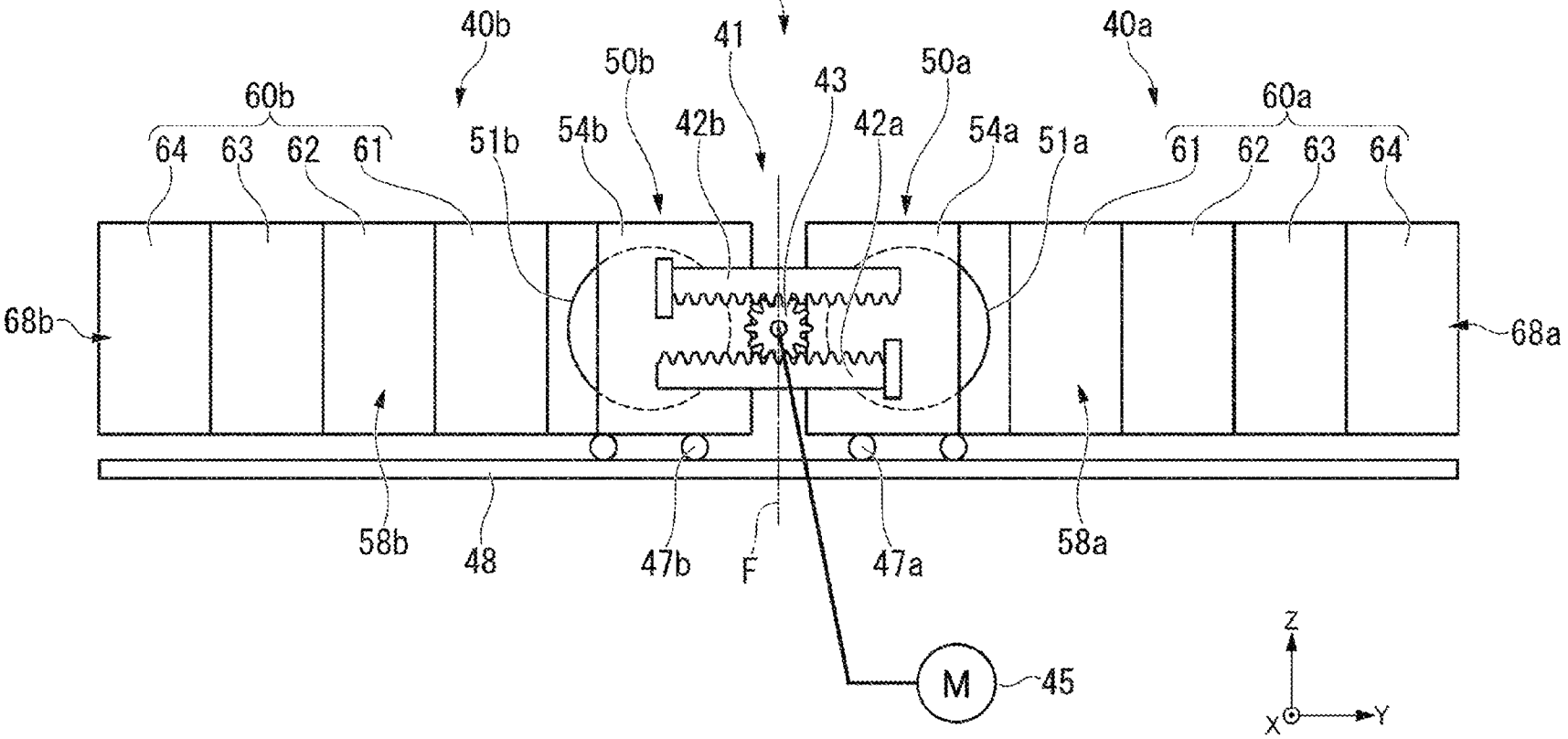
FIG. 6 illustrates a side view of the cooling device.

FIG. 6 illustrates a side view of the cooling device in the direction of an arrow VI in FIG. 4.

The movement mechanism 41 moves the first movement portion 50*a* and the second movement portion 50*b* in the Y direction. The movement mechanism 41 moves the first movement portion 50*a* and the second movement portion 50*b* to be plane-symmetric with respect to the symmetric plane F. The movement mechanism 41 includes a first rack 42*a*, a second rack 42*b*, a pinion gear 43, a motor 45, a first wheel 47*a*, a second wheel 47*b*, and a rail 48.

The first rack 42*a* is connected to the first movement portion 50*a* to stretch in the −Y direction. The second rack 42*b* is connected to the second movement portion 50*b* to stretch in the +Y direction. The pinion gear 43 is disposed between the first rack 42*a* and the second rack 42*b* in the Z direction to engage with both the first rack 42*a* and the second rack 42*b*. The motor 45 rotates the pinion gear 43. For example, the motor 45 is a stepping motor. The first wheel 47*a* is mounted in the −Z direction of the first movement portion 50*a*. The second wheel 47*b* is mounted in the −Z direction of the second movement portion 50*b*. The rail 48 is disposed in the −Z direction of the first wheel 47*a* and the second wheel 47*b* to guide rolling of the first wheel 47*a* and the second wheel 47*b*.

When the pinion gear 43 is rotated by the motor 45, the first rack 42*a* and the second rack 42*b* are moved in the Y direction to be plane-symmetric with respect to the symmetric plane F. Thus, the first movement portion 50*a* and the second movement portion 50*b* move in the Y direction to be plane-symmetric with respect to the symmetric plane F. When the first movement portion 50*a* moves in the Y direction, the partial ducts 62 and 63 of the first cooling duct 60*a* move together in the Y direction. The same applies to the second movement portion 50*b*.

As illustrated in FIG. 4, R is a distance between an end 59*a* of the first cooling port 58*a* of the first cooling device 40*a* in the −Y direction and an end 59*b* of the second cooling port 58*b* of the second cooling device 40*b* in the +Y direction. For example, the movement mechanism 41 is formed so that the distance R is changed within a range equal to or greater than 105 mm and equal to or less than 155 mm.

The control unit 6 controls an operation of the fixing device 30. The control unit 6 controls operations of the first fan 51*a*, the second fan 51*b*, and the movement mechanism 41 of the cooling device 40.

As described above, the fixing device 30 heats the toner images of the sheet S passing through the nip N to fix the toner images to the sheet S. In a printing state of the image forming apparatus 1, the control unit 6 maintains the temperature of the fixing belt 38 at a predetermined fixing temperature. In a printing standby state of the image forming apparatus 1, the control unit 6 maintains the temperature of the fixing belt 38 at a standby temperature lower than the fixing temperature.

The sheet S passes through the middle of the nip N in the Y direction. The sheet S deprives the fixing belt 38 of heat while being passed through the nip N. A sheet passing region of the fixing belt 38 is maintained at the fixing temperature while being deprived of the heat by the sheet S. Since a sheet non-passing region of the fixing belt 38 is not deprived of the heat by the sheet S, the temperature of the region becomes high. The control unit 6 controls the cooling device 40 to cool the sheet non-passing region of the fixing belt 38. The control unit 6 causes the cooling device 40 to operate simultaneously with the start of a printing job.

Figure 7:
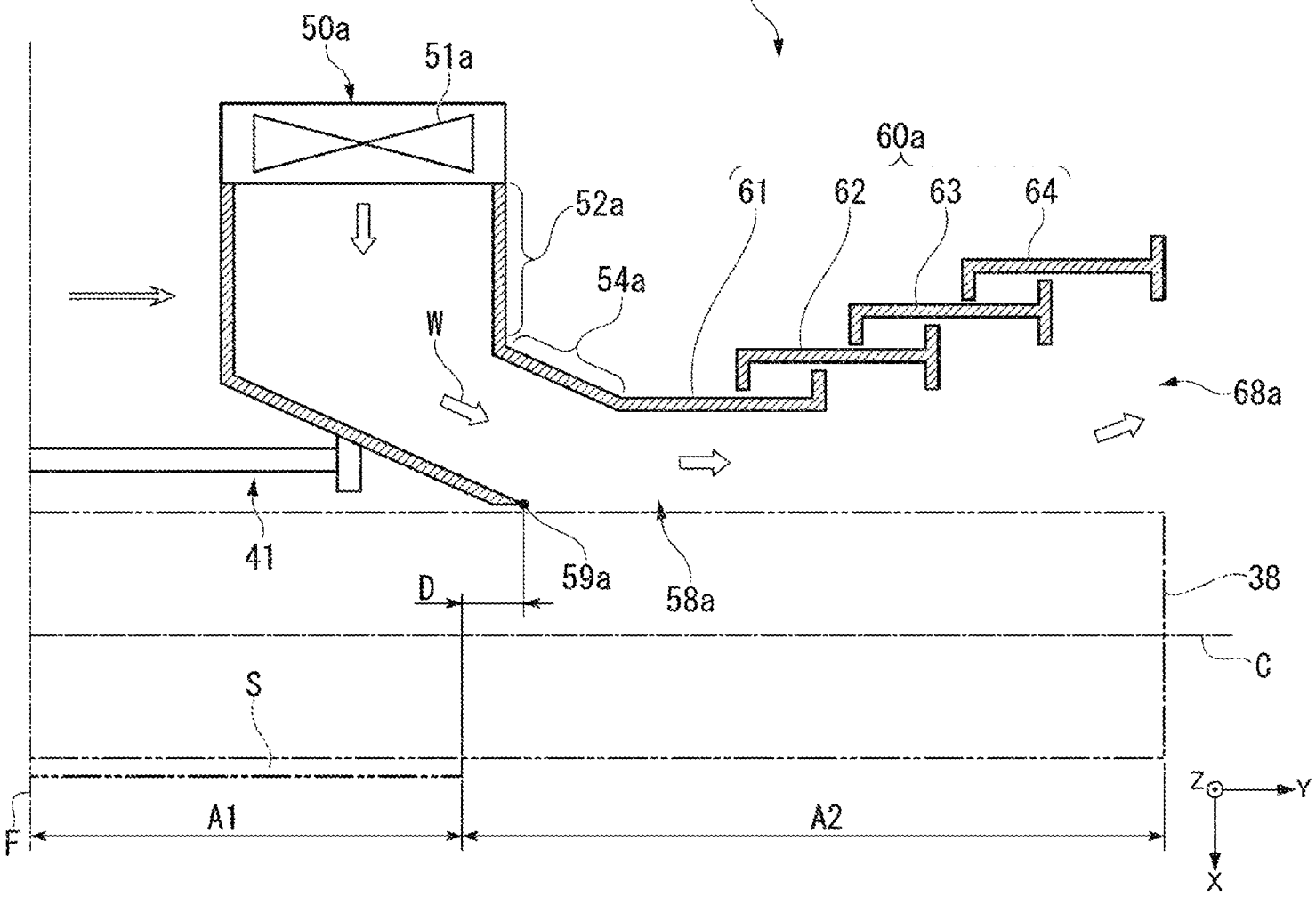
FIG. 7 is a diagram illustrating an operation of the first cooling device.

FIG. 7 is a diagram illustrating an operation of the first cooling device. The control unit 6 drives the movement mechanism 41 in accordance with the size of the sheet S passing through the nip N to move the first movement portion 50*a* in the Y direction. The control unit 6 moves the first movement portion 50*a* so that the end 59*a* of the first cooling port 58*a* of the first cooling device 40*a* in the −Y direction is located in the +Y direction from the end of the sheet S in the +Y direction.

The control unit 6 drives the first fan 51*a* to send off a first cooling wind W from the first fan 51*a*. The first cooling wind W flows in the first introduction duct 54*a* through the first connection duct 52*a*. The first introduction duct 54*a* stretches in the +Y direction as approaching the rotation axis C of the fixing belt 38 (being oriented in the +X direction). Therefore, the first cooling wind W flowing out from the first introduction duct 54*a* flows in the +Y direction along the outer circumferential surface of the fixing belt 38. The first cooling wind W cools a sheet non-passing region A2 of the fixing belt 38 when the first cooling wind W is in contact with the outer circumferential surface of the fixing belt 38 in the first cooling port 58*a*.

As described above, the first introduction duct 54*a* stretches in the +Y direction as approaching the rotation axis C of the fixing belt 38 (being oriented in the +X direction). Therefore, the first cooling wind W flowing out from the first introduction duct 54*a* is less likely to flow in the −Y direction around the end 59*a* of the first cooling port 58*a* in the −Y direction. A sheet passing region A1 of the fixing belt 38 is less likely to be cooled by the first cooling wind W. The temperature of the sheet passing region A1 of the fixing belt 38 is maintained at the fixing temperature even when output of the heater 34 is raised. As described above, the sheet non-passing region A2 of the fixing belt 38 is efficiently cooled.

The control unit 6 includes a movement control unit. The movement control unit moves the first movement portion 50*a* so that the end 59*a* of the first cooling port 58*a* in the −Y direction is disposed at a position away by a predetermined distance D in the +Y direction from the end of the sheet S subjected to the fixing process in the +Y direction. For example, the predetermined distance D is equal to or greater than 2 mm and equal to or less than 3 mm. When the outer circumferential surface of the fixing belt 38 facing the first cooling port 58*a* is cooled by the first cooling wind W, the fixing belt 38 in the periphery of the first cooling port 58*a* is cooled by heat transmission. In the foregoing configuration, substantially the entire sheet non-passing region A2 is cooled while suppressing the cooling of the sheet passing region A1 of the fixing belt 38. Accordingly, the sheet non-passing region A2 of the fixing belt 38 can be efficiently cooled.

The control unit 6 includes a first operation control unit. The first operation control unit causes the cooling device 40 to operate when the width of the sheet S subjected to the fixing process in the Y direction is less than a predetermined width. For example, the predetermined width is 150 mm. When the width of the sheet S in the Y direction is large, most of the fixing belt 38 is deprived of heat by the sheet S, the temperature of the sheet non-passing region A2 of the fixing belt 38 is less likely to become high. In this case, the control unit 6 does not cause the cooling device 40 to operate. Conversely, when the width of the sheet S in the Y direction is less than the predetermined width, there is a possibility that the temperature of the sheet non-passing region A2 of the fixing belt 38 becomes high. In this case, the control unit 6 causes the cooling device 40 to operate. Thus, since the operation of the cooling device 40 is limited to a necessary case, power consumption of the cooling device 40 can be suppressed.

The control unit 6 includes a second operation control unit. The second operation control unit causes the cooling device 40 to operate when the number of sheets S continuously subjected to the fixing process is equal to or greater than a predetermined number. When the number of sheets S continuously subjected to the fixing process is small, a temperature difference is small between the sheet passing region A1 deprived of heat by the sheet S and the sheet non-passing region A2 not deprived of heat by the sheet S. That is, the temperature of the sheet non-passing region A2 of the fixing belt 38 is less likely to become high. In this case, the control unit 6 does not cause the cooling device 40 to operate. In contrast, when the number of sheets S continuously subjected to the fixing process is equal to or greater than the predetermined number, the temperature difference is large between the sheet passing region A1 and the sheet non-passing region A2. That is, there is a possibility that the temperature of the sheet non-passing region A2 of the fixing belt 38 becomes high. In this case, the control unit 6 causes the cooling device 40 to operate. Thus, since an operation of the cooling device 40 is limited to a necessary case, power consumption of the cooling device 40 can be suppressed.

The control unit 6 includes a third operation control unit. The third operation control unit causes the cooling device 40 to operate when the temperature of the end of the fixing belt 38 in the Y direction is equal to or higher than a predetermined temperature. The temperature of the end of the fixing belt 38 in the Y direction is detected by the end temperature sensor 39*n* (see FIG. 4). Thus, the sheet non-passing region A2 of the fixing belt 38 can be efficiently cooled.

As described above, the fixing device 30 according to the first embodiment includes the fixing belt 38, the first fan 51*a*, the first introduction duct 54*a*, the first cooling duct 60*a*, and the movement mechanism 41. The heater 34 is disposed inside the fixing belt 38. The first fan 51*a* generates the first cooling wind W for cooling the fixing belt 38. The first cooling wind W flows in from the end of the first introduction duct 54*a* on the side of the first fan 51*a*. The first introduction duct 54*a* stretches in the +Y direction as approaching the rotation axis C of the fixing belt 38. The first cooling duct 60*a* stretches in the +Y direction along the outer circumferential surface of the fixing belt 38 from the end of the first introduction duct 54*a* on the side of the fixing belt 38. The first exhaust port 68*a* is open to the front end of the first cooling duct 60*a* in the +Y direction. The first cooling port 58*a* is opened to the first cooling duct 60*a* along the outer circumferential surface of the fixing belt 38. The movement mechanism 41 moves the first movement portion 50*a* including the first fan 51*a*, the first introduction duct 54*a*, and the partial duct 61 of the first cooling duct 60*a* in the Y direction.

The first introduction duct 54*a* stretches in the +Y direction as approaching the rotation axis C of the fixing belt 38. The first cooling wind W flowing from the first introduction duct 54*a* flows in the +Y direction along the outer circumferential surface of the fixing belt 38. The first cooling wind W cools the sheet non-passing region A2 of the fixing belt 38 when the first cooling wind W is in contact with the outer circumferential surface of the fixing belt 38 in the first cooling port 58*a*. The first cooling wind W flowing from the first introduction duct 54*a* is less likely to flow in the −Y direction around the end 59*a* of the first cooling port 58*a* in the −Y direction. The sheet passing region A1 of the fixing belt 38 is less likely to be cooled by the first cooling wind W. As described above, the sheet non-passing region A2 of the fixing belt 38 is efficiently cooled. The first cooling wind W generated by the first fan 51*a* is used to cool the outer circumferential surface of the fixing belt 38 without reducing a passage and a flow rate. Accordingly, the sheet non-passing region A2 of the fixing belt 38 can be efficiently cooled.

The relative position of first exhaust port 68*a* with respect to the fixing belt 38 in the Y direction is fixed. The first cooling duct 60*a* is formed to be expandable and contractible in the Y direction.

In this configuration, the position of the first exhaust port 68*a* is not moved even when the first movement portion 50*a* is moved. Accordingly, an increase in the size of the fixing device 30 can be suppressed.

The first cooling duct 60*a* is formed by combining the plurality of partial ducts 61 to 64 in the Y direction. The outer shapes of the plurality of partial ducts 61 to 64 on the XZ cross sections orthogonal to the rotation axis C increase in the +Y direction.

Thus, the first cooling duct 60*a* is formed to be expandable and contractible. Since the outer shapes of the plurality of partial ducts 61 to 64 increase in the +Y direction, passage resistance of the first cooling duct 60*a* decreases in the +Y direction. Therefore, leakage of the first cooling wind W from a gap between the first cooling duct 60*a* and the fixing belt 38 is suppressed. Accordingly, the sheet non-passing region A2 of the fixing belt 38 is efficiently cooled.

The fixing device 30 includes the second fan 51*b*, the second introduction duct 54*b*, and the second cooling duct 60*b*. The second fan 51*b* generates a second cooling wind for cooling the fixing belt 38. The second cooling wind flows in from the end of the second introduction duct 54*b* on the side of the second fan 51*b*. The second introduction duct 54*b* stretches in the −Y direction as approaching the fixing belt 38. The second cooling duct 60*b* stretches in the −Y direction from the end of the second introduction duct 54*b* on the side of the fixing belt 38 along the outer circumference of the fixing belt 38. A second exhaust port 68*b* is open to the front end of the second cooling duct 60*b* in the −Y direction. The second cooling port 58*b* is open to the second cooling duct 60*b* along the outer circumferential surface of the fixing belt 38. The movement mechanism 41 moves the second movement portion 50*b* including the second fan 51*b*, the second introduction duct 54*b*, and the partial duct 61 of the second cooling duct 60*b* in the Y direction.

The first cooling device 40*a* including the first fan 51*a*, the first introduction duct 54*a*, and the first cooling duct 60*a* is disposed in the +Y direction from a center of the fixing belt 38 in the Y direction. The second cooling device 40*b* including the second fan 51*b*, the second introduction duct 54*b*, and the second cooling duct 60*b* is disposed in the −Y direction from the center of the fixing belt 38 in the Y direction.

In this configuration, the sheet non-passing regions A2 at both ends of the fixing belt 38 in the Y direction are cooled when a middle portion of the fixing belt 38 in the Y direction serves as the sheet passing region A1.

The movement mechanism 41 moves the first movement portion 50*a* and the second movement portion 50*b* to be plane-symmetric with respect to the plane F which is orthogonal to the rotation axis C and passes through the center of the fixing belt 38 in the Y direction.

In this configuration, the sheet non-passing regions A2 at both ends of the fixing belt 38 in the Y direction are evenly cooled.

The image forming apparatus 1 according to the first embodiment includes the fixing device 30 and the control unit 6. The fixing device 30 performs a fixing process on an image on the sheet S. The control unit 6 controls the operations of the first fan 51*a* and the movement mechanism 41 of the fixing device 30.

In this configuration, since the sheet non-passing region A2 of the fixing belt 38 is efficiently cooled, power consumption of the image forming apparatus 1 is suppressed.

The control unit 6 moves the first movement portion 50*a* so that the end 59*a* of the first cooling port 58*a* of the first cooling duct 60*a* in the −Y direction is disposed at a position away by the predetermined distance D in the +Y direction from the end of the sheet S subjected to the fixing process in the +Y direction.

When the outer circumferential surface of the fixing belt 38 facing the first cooling port 58*a* is cooled by the first cooling wind W, the fixing belt 38 in the periphery of the first cooling port 58*a* is also cooled by heat transmission. In the foregoing configuration, substantially the entire sheet non-passing region A2 is cooled while suppressing the cooling of the sheet passing region A1 of the fixing belt 38. Accordingly, the sheet non-passing region A2 of the fixing belt 38 is efficiently cooled.

The control unit 6 causes the cooling device 40 to operate when the width of the sheet S subjected to the fixing process in the Y direction is less than the predetermined width.

When the width of the sheet S in the Y direction is large, most of the fixing belt 38 is deprived of heat by the sheet S. Therefore, the temperature of the sheet non-passing region A2 of the fixing belt 38 is less likely to become high. In contrast, when the width of the sheet S in the Y direction is less than the predetermined width, there is a possibility that the temperature of the sheet non-passing region A2 of the fixing belt 38 becomes high. In the foregoing configuration, since the operation of the cooling device 40 is limited to a necessary case, power consumption of the cooling device 40 can be suppressed.

The control unit 6 causes the cooling device 40 to operate when the number of sheets S continuously subjected to the fixing process is equal to or greater than a predetermined number.

When the number of sheets S continuously subjected to the fixing process is small, a temperature difference is small between the sheet passing region A1 deprived of heat by the sheet S and the sheet non-passing region A2 not deprived of heat by the sheet S. That is, the temperature of the sheet non-passing region A2 of the fixing belt 38 is less likely to become high. In contrast, when the number of sheets S continuously subjected to the fixing process is equal to or greater than the predetermined number, the temperature difference is large between the sheet passing region A1 and the sheet non-passing region A2. That is, there is a possibility that the temperature of the sheet non-passing region A2 of the fixing belt 38 becomes high. In the foregoing configuration, since an operation of the cooling device 40 is limited to a necessary case, power consumption of the cooling device 40 can be suppressed.

The control unit 6 causes the cooling device 40 to operate when the temperature of the end of the fixing belt in the Y direction is equal to or higher than the predetermined temperature.

In this configuration, the sheet non-passing region A2 of the fixing belt 38 is efficiently cooled.

Figure 8:
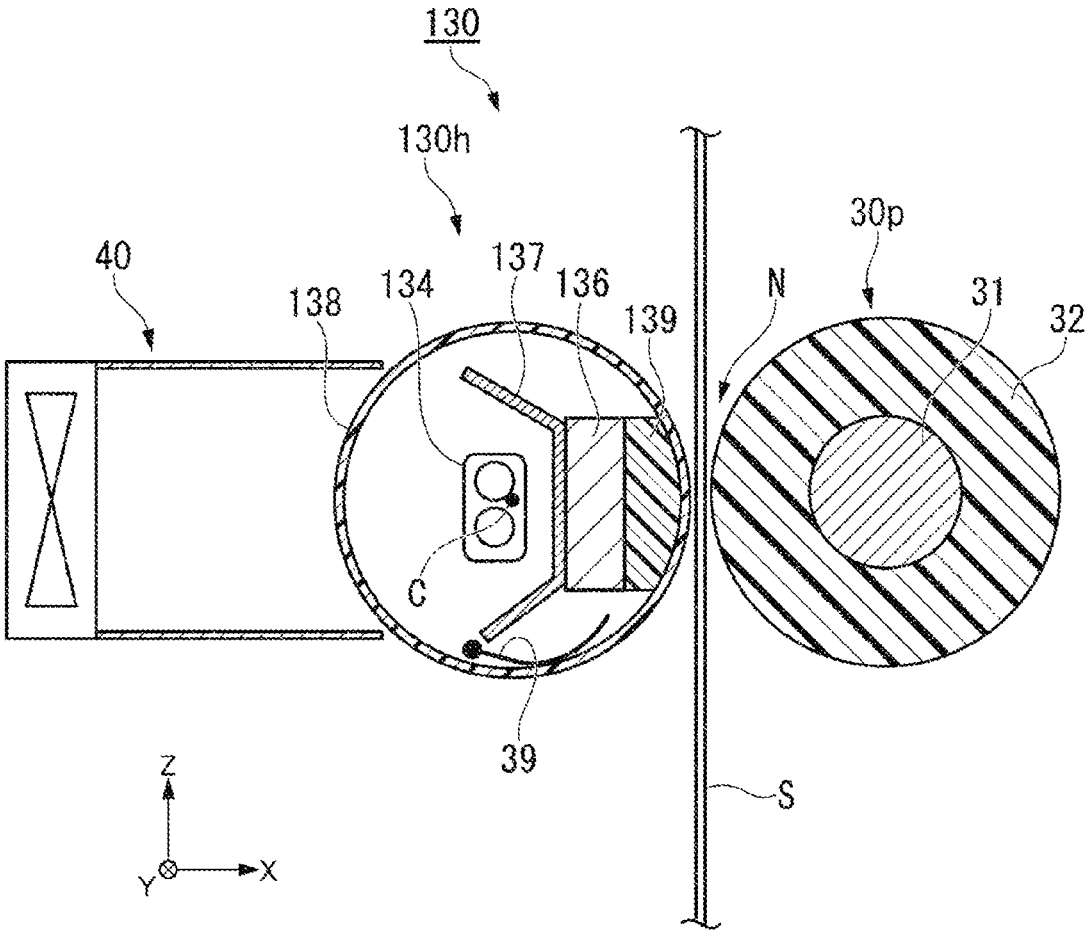
FIG. 8 illustrates a front cross-sectional view of a heating device according to a modification example of the first embodiment.

FIG. 8 illustrates a front cross-sectional view of a heating device according to a modification example of the first embodiment. The heating device according to the modification example is a fixing device 130 of a heating lamp type. In the fixing device 130 according to the modification example, portions similar to those of the first embodiment will not be described.

The fixing device 130 includes the pressure roller 30*p*, a heating roller 130*h*, and the cooling device 40.

The heating roller 130*h* includes a heating lamp (heat source) 134, a reflection member 137, a support member 136, a pressure pad 139, and a fixing belt (rotator) 138. The heating lamp 134, the reflection member 137, the support member 136, and the pressure pad 139 stretches in a direction of a rotation axis C of the fixing belt 138 and are disposed inside the fixing belt 138.

The heating lamp 134 is disposed near the rotation axis C of the fixing belt 138. For example, the heating lamp 134 is a halogen lamp.

The reflection member 137 is disposed on the side of the pressure roller 30*p* with respect to the heating lamp 134. The reflection member 137 stretches to surround the heating lamp 134. The reflection member 137 reflects heat radiated from the heating lamp 134 toward the inner circumferential surface of the fixing belt 138.

The support member 136 is disposed on the side of the pressure roller 30*p* with respect to the reflection member 137. The support member 136 supports the heating lamp 134, the reflection member 137, and the pressure pad 139.

The pressure pad 139 is disposed on the side of the pressure roller 30*p* with respect to the support member 136. For example, the pressure pad 139 is formed of a soft material such as silicon rubber.

The fixing belt 138 is a cylindrical endless belt. When the pressure roller 30*p* comes into contact with the heating roller 130*h*, the nip N is formed between the pressure roller 30*p* and the fixing belt 138. The pressure pad 139 inside the fixing belt 138 is deformed and the width of the nip N in the transport direction of the sheet S is ensured. When the pressure roller 30*p* is rotatably driven, the fixing belt 138 is driven to rotate about the rotation axis C by a frictional force. When the sheet S is passed through the nip N, the toner images transferred to the sheet S are heated and pressurized. Thus, the fixing device 130 fixes the toner images to the sheet S.

The fixing belt 138 according to the modification example is cooled by the cooling device 40 similar to that of the embodiment. Thus, the sheet non-passing region of the fixing belt 138 is efficiently cooled.

Second Embodiment

Figure 9:
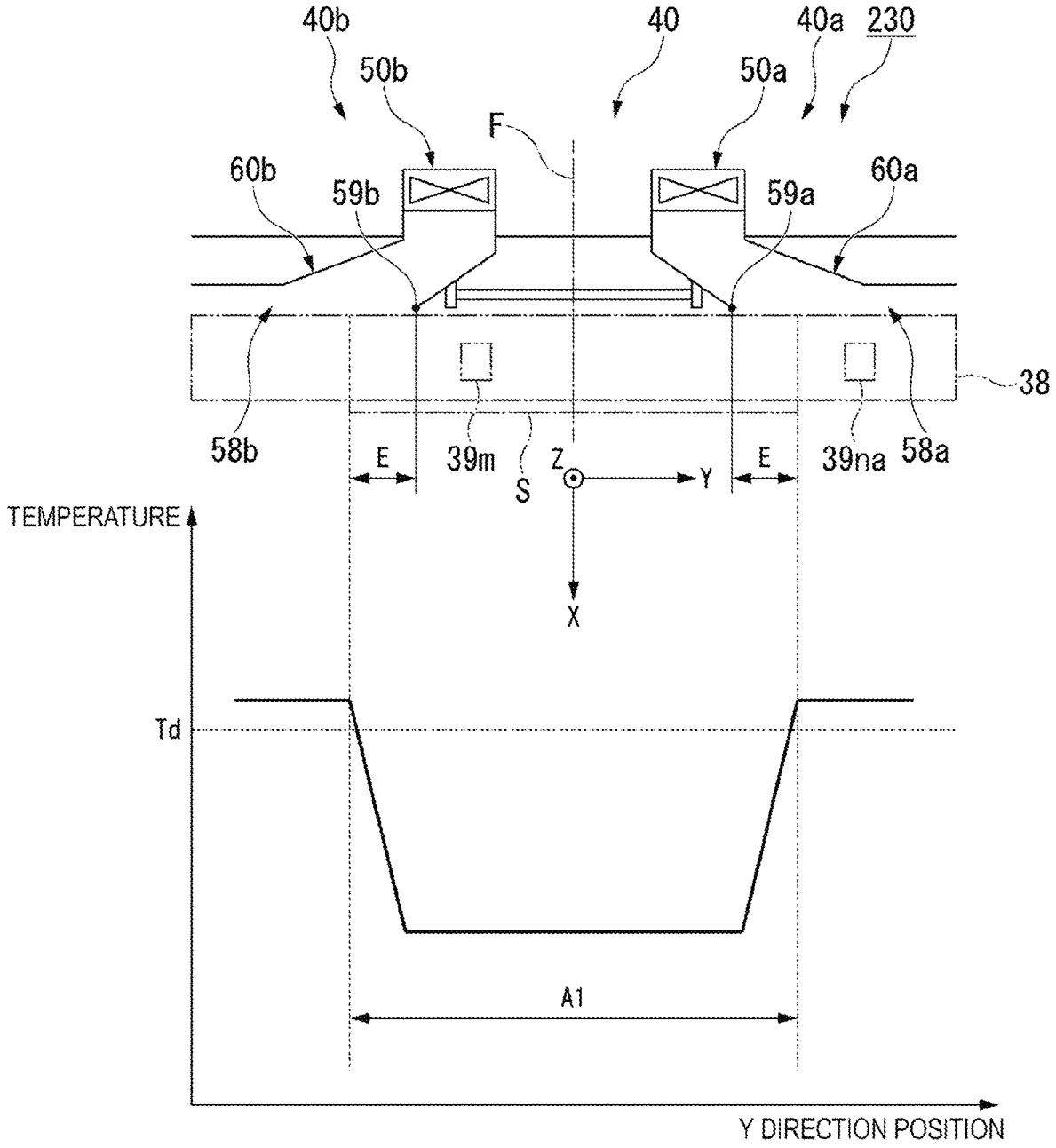
FIG. 9 illustrates a heating device according to a second embodiment in a first state.

FIG. 9 illustrates a heating device according to a second embodiment in a first state. A heating device 230 of the second embodiment is different from that of the first embodiment in that the first movement portion 50*a* and the second movement portion 50*b* are moved based on the temperature of the fixing belt 38. The description of the second embodiment that is the same as that of the first embodiment will be omitted.

As described above, the middle portion of the fixing belt 38 in the Y direction is the sheet passing region A1 of the sheet S. The sheet S deprives the heat of the fixing belt 38 while being passed through the nip N. The sheet passing region A1 of the fixing belt 38 is maintained at the fixing temperature while being deprived of the heat by the sheet S. The middle temperature sensor 39*m* is used to detect the temperature of the fixing belt 38 at the middle portion of the fixing belt 38 in the Y direction. The control unit 6 controls the conduction to the heater based on the temperature detected by the middle temperature sensor 39*m* and maintains the fixing belt 38 at the fixing temperature. The fixing temperature is a temperature within a temperature range that is allowed for the fixing process (hereinafter, referred to as a fixing temperature range).

Since the sheet non-passing region of the fixing belt is not deprived of the heat by the sheet S, the temperature thereof may become high. When the sheet non-passing region of the fixing belt 38 becomes the high temperature, even though the middle portion of the sheet passing region A1 in the Y direction is within the fixing temperature range, there is a possibility that an end of the sheet passing region A1 in the Y direction is out of the fixing temperature range. Thus, a high temperature offset exceeding an upper limit of the fixing temperature range may occur at the end of the sheet passing region A1 of the fixing belt 38 in the Y direction.

The heating device 230 includes a first end temperature sensor (a first temperature sensor) 39*na* as an end temperature sensor. The first end temperature sensor 39*na* can output a signal corresponding to a temperature of the end of the fixing belt 38 in the +Y direction (hereinafter, referred to as a first temperature). When the middle portion of the fixing belt 38 in the Y direction is the sheet passing region A1, the end of the fixing belt 38 in the +Y direction is the sheet non-passing region.

The control unit 6 detects the first temperature of the end of the fixing belt 38 in the +Y direction based on the output signal of the first end temperature sensor 39*na*. When the detected first temperature is equal to or higher than a predetermined temperature Td, the control unit 6 determines that the high temperature offset occurred at the end of the sheet passing region A1 of the fixing belt 38 in the +Y direction. The predetermined temperature Td is obtained in advance by an experiment and recorded in the control unit 6. The predetermined temperature Td may be set to a different value corresponding to a width of the sheet S in the Y direction.

In this case, the control unit 6 moves the first movement portion 50*a* so that the end (hereinafter, referred to as a first end) 59*a* of the first cooling port 58*a* of the first cooling device 40*a* in the −Y direction is located at a first position. The first position is a position away by a predetermined distance E in the −Y direction from the end of the sheet S in the +Y direction. The predetermined distance E is obtained in advance by an experiment and recorded in the control unit 6. The cooling device 40 blows cooling air to an outer peripheral surface of the fixing belt 38 facing the first cooling port 58*a*. The cooling device 40 cools not only the sheet non-passing region of the fixing belt 38 but also the end of the sheet passing region A1 in the +Y direction. Thus, the high temperature offset occurring at the end of the sheet passing region A1 of the fixing belt 38 in the +Y direction is suppressed.

As illustrated in FIG. 4, the heating device includes the middle heater 34*m* and the pair of end heaters 34*n*. The pair of end heaters 34*n* are disposed at both ends of the fixing belt 38 in the Y direction. Heat generation of the pair of end heaters 34*n* is controlled in the same manner. The temperature distribution of the fixing belt 38 is often plane-symmetric with respect to the symmetric plane F. When determining that the high temperature offset occurs at the end of the sheet passing region of the fixing belt 38 in the +Y direction, the control unit 6 determines that the high temperature offset also occurred at the end thereof in the −Y direction. The first movement portion 50*a* and the second movement portion 50*b* move in the Y direction to be plane-symmetric with respect to the symmetric plane F. The first cooling device 40*a* cools the end of the sheet passing region of the fixing belt 38 in the +Y direction, and the second cooling device 40*b* cools the end thereof in the −Y direction. Thus, the high temperature offset occurring at both ends of the sheet passing region A1 in the Y direction can be suppressed.

Figure 10:
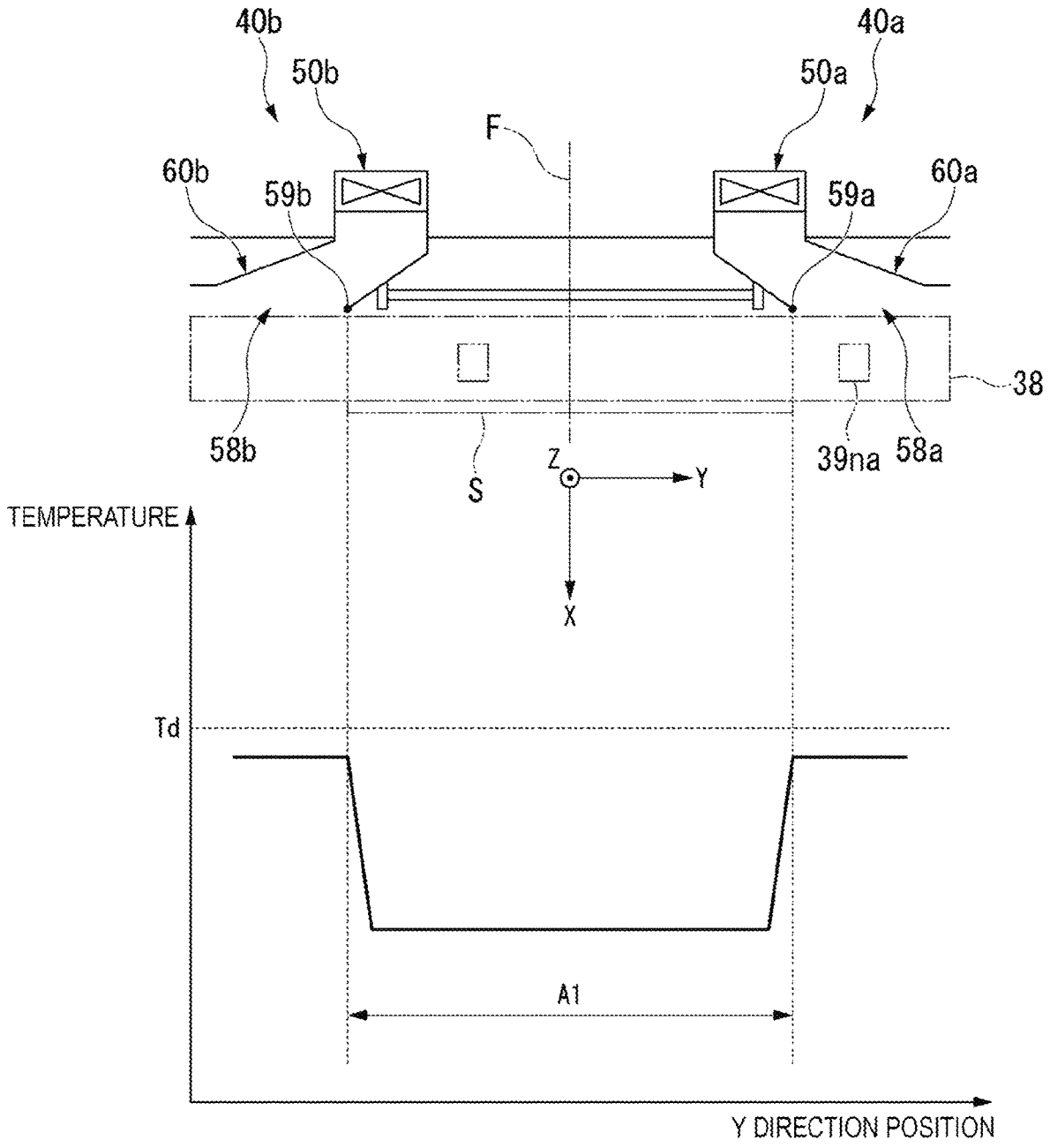
FIG. 10 illustrates the heating device according to the second embodiment in a second state.

FIG. 10 illustrates the heating device according to the second embodiment in a second state. The control unit 6 detects the first temperature of the end of the fixing belt 38 in the +Y direction based on the output signal of the first end temperature sensor 39*na*. When the detected first temperature is lower than the predetermined temperature Td, the control unit 6 determines that the high temperature offset does not occur at the end of the sheet passing region A1 of the fixing belt 38 in the Y direction. In this case, the control unit 6 moves the first movement portion 50*a* so that the first end 59*a* of the first cooling device 40*a* is located at a position of the end of the sheet S in the +Y direction. Thus, the sheet non-passing region of the fixing belt 38 is mainly cooled, and the cooling of the end of the sheet passing region A1 in the Y direction can be suppressed. Accordingly, the sheet passing region A1 of the fixing belt 38 can be maintained within the fixing temperature range. The control unit 6 may move the first movement portion 50*a* so that the first end 59*a* is located at a position indicated in FIG. 7. The position indicated in FIG. 7 is a position away by the predetermined distance D in the +Y direction from the end of the sheet S in the +Y direction. Thus, the cooling of the end of the sheet passing region A1 of the fixing belt 38 in the +Y direction is suppressed, and the sheet passing region A1 is maintained within the fixing temperature range.

As described above, the heating device 230 according to the second embodiment includes the first end temperature sensor 39*na* that can output the signal corresponding to the first temperature of the end of the fixing belt 38 in the +Y direction. The control unit 6 moves the first movement portion 50*a* when the first temperature detected based on the output signal of the first end temperature sensor 39*na* is equal to or higher than the predetermined temperature Td. The control unit 6 moves the first movement portion so that the first end 59*a* of the first cooling port 58*a* of the first cooling duct 60*a* in the −Y direction is located at the first position. The first position is a position away by the predetermined distance E in the −Y direction from the end of the sheet S subjected to a heating process in the +Y direction.

When the first temperature is equal to or higher than the predetermined temperature Td, there is a high possibility that the high temperature offset occurred at the end of the sheet passing region A1 of the fixing belt 38 in the +Y direction. The first end 59*a* is located at the first position, whereby the end of the sheet passing region A1 in the +Y direction is cooled in addition to the sheet non-passing region of the fixing belt 38. Therefore, the high temperature offset occurring at the end of the sheet passing region A1 of the fixing belt 38 in the +Y direction can be suppressed.

When the first temperature detected based on the output signal of the first end temperature sensor 39*na* is lower than the predetermined temperature Td, the control unit 6 moves the first movement portion 50*a*. The control unit 6 moves the first movement portion 50*a* so that the first end 59*a* of the first cooling port 58*a* of the first cooling duct 60*a* in the −Y direction is located at the position of the end of the sheet S subjected to the heating process in the +Y direction.

When the first temperature is lower than the predetermined temperature Td, there is a low possibility that the high temperature offset occurred at the end of the sheet passing region A1 of the fixing belt 38 in the +Y direction. The cooling of the end of the sheet passing region A1 of the fixing belt 38 in the +Y direction is suppressed by arranging the first end 59*a* at the above-mentioned position. Therefore, the sheet passing region A1 of the fixing belt 38 can be maintained within the fixing temperature range.

A first modification example of the second embodiment will be described.

Figure 11:
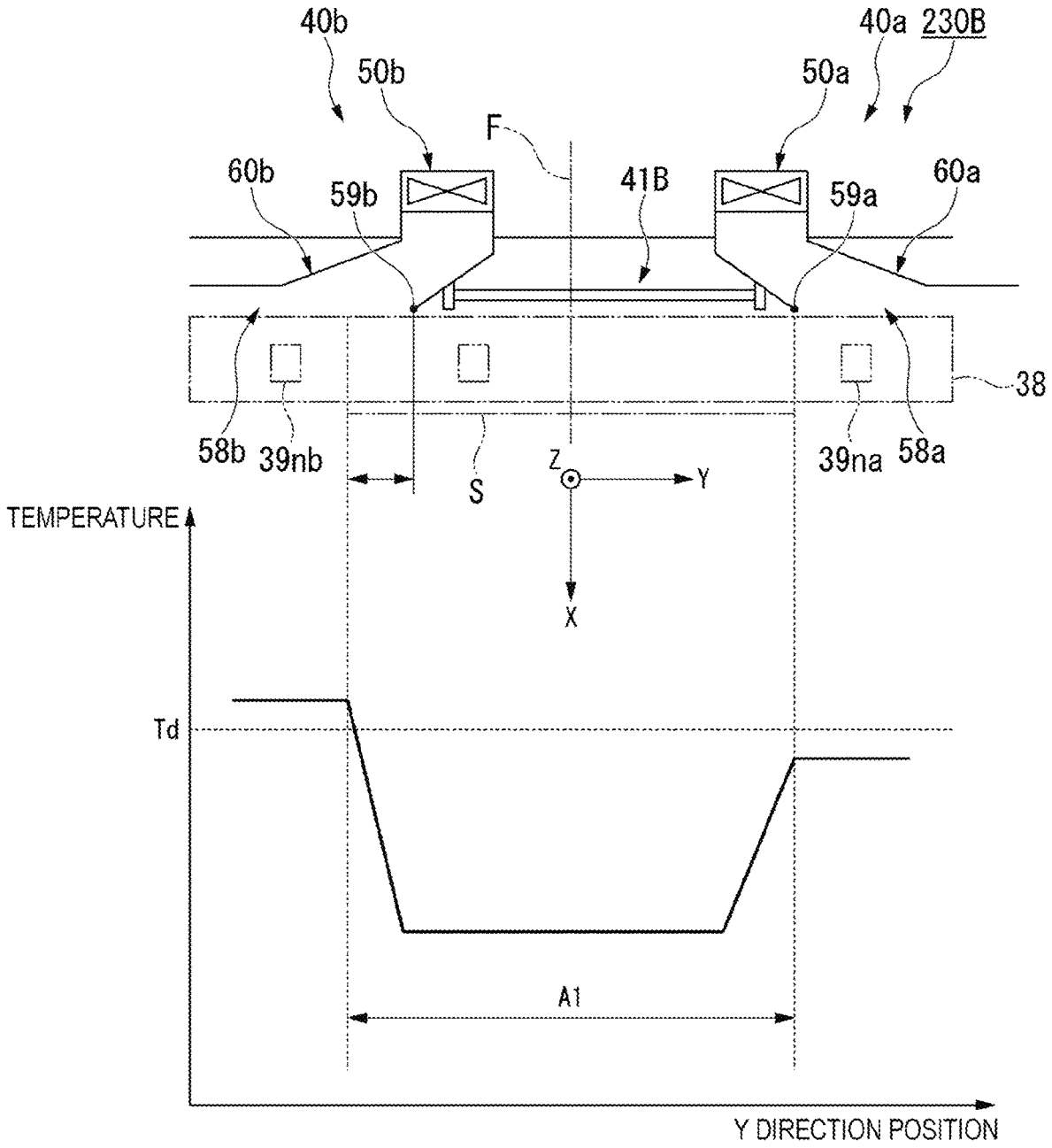
FIG. 11 illustrates a heating device according to a first modification example of the second embodiment.

FIG. 11 illustrates a heating device according to a first modification example of the second embodiment. A heating device 230B of the first modification example is different from that of the second embodiment in that the heating device 230B includes a second end temperature sensor 39*nb* in addition to the first end temperature sensor 39*na*.

The description of the first modification example that is the same as that of the second embodiment will be omitted.

The heating device 230B includes the second end temperature sensor (a second temperature sensor) 39*nb* as the end temperature sensor 39*n* in addition to the first end temperature sensor 39*na*. The second end temperature sensor 39*nb* can output a signal corresponding to a temperature of the end of the fixing belt 38 in the −Y direction (hereinafter, referred to as a second temperature). The control unit 6 detects the second temperature of the fixing belt 38 based on the output signal of the second end temperature sensor 39*nb*.

The temperature distribution of the fixing belt 38 may not become plane-symmetric with respect to the symmetric plane F. Even when the high temperature offset does not occur at the end of the sheet passing region A1 of the fixing belt 38 in the +Y direction, the high temperature offset may occur at the end thereof in the −Y direction.

The control unit 6 detects the first temperature of the sheet non-passing region of the fixing belt 38 based on the output signal of the first end temperature sensor 39*na*. When the detected first temperature is lower than the predetermined temperature Td, the control unit 6 determines that the high temperature offset does not occur at the end of the sheet passing region A1 of the fixing belt 38 in the +Y direction. In this case, the control unit 6 moves the first movement portion 50*a* so that the first end 59*a* of the first cooling device 40*a* is located at the end of the sheet passing region A1 in the +Y direction. Thus, the sheet non-passing region of the fixing belt 38 is mainly cooled, and the cooling of the end of the sheet passing region A1 in the Y direction is suppressed. Therefore, the sheet passing region A1 of the fixing belt 38 is maintained within the fixing temperature range.

The control unit 6 detects the second temperature of the fixing belt 38 based on the output signal of the second end temperature sensor 39*nb*. When the detected second temperature is equal to or higher than the predetermined temperature Td, the control unit 6 determines that the high temperature offset occurs at the end of the sheet passing region A1 of the fixing belt 38 in the −Y direction. In this case, the control unit 6 moves the second movement portion 50*b* so that the second end 59*b* of the second cooling device 40*b* is located at a second position. The second position is a position away by the predetermined distance E in the +Y direction from the end of the sheet S in the −Y direction. Thus, the end of the sheet passing region A1 in the −Y direction is cooled in addition to the sheet non-passing region of the fixing belt 38. Therefore, the high temperature offset occurring at the end of the sheet passing region A1 of the fixing belt 38 in the −Y direction can be suppressed.

A movement mechanism 41B moves the first movement portion 50*a* and the second movement portion 50*b* independently from each other. For example, the first movement portion 50*a* and the second movement portion 50*b* respectively include a rack and a pinion gear. The respective pinion gears are rotated and driven independently of each other by a separate motor. Thus, the first end 59*a* of the first cooling device 40*a* and the second end 59*b* of the second cooling device 40*b* can be located at a position which is not plane-symmetric with respect to the symmetric plane F.

As described above, the heating device 230B according to the first modification example includes the second end temperature sensor 39*nb* capable of outputting the signal corresponding to the second temperature of the end of the fixing belt 38 in the −Y direction. When the second temperature detected based on the output signal of the second end temperature sensor 39*nb* is equal to or higher than the predetermined temperature Td, the control unit 6 moves the second movement portion 50*b*. The control unit 6 moves the second movement portion 50*b* so that the second end 59*b* of the second cooling port 58*b* of the second cooling duct 60*b* in the +Y direction is located at the second position. The second position is a position away by the predetermined distance E in the +Y direction from the end of the sheet S subjected to the heating process in the −Y direction. The movement mechanism 41B moves the first movement portion 50*a* and the second movement portion 50*b* independently of each other.

The heating device 230B according to the first modification example can detect the high temperature offset occurring only at one end of both ends of the sheet passing region A1 of the fixing belt 38 in the Y direction. The heating device 230B can cool only one end of the sheet passing region A1 of the fixing belt 38 in the Y direction without cooling the other end thereof. Thus, the high temperature offset occurring only at one end of the sheet passing region A1 of the fixing belt 38 in the Y direction is suppressed. Therefore, the sheet passing region A1 of the fixing belt 38 is maintained within the fixing temperature range.

A second modification example of the second embodiment will be described.

Figure 12:
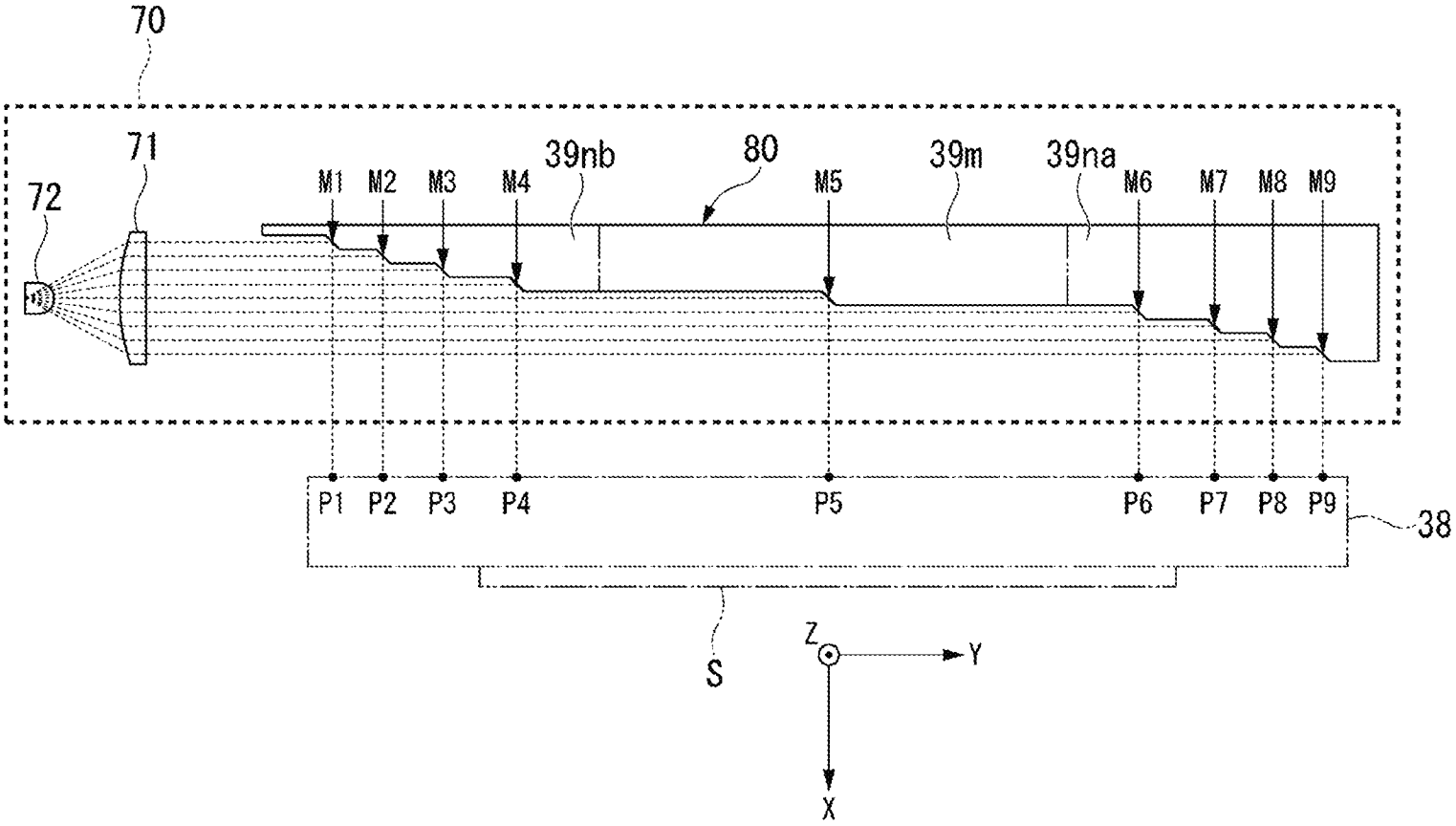
FIG. 12 illustrates a temperature sensor according to a second modification example of the second embodiment.

FIG. 12 illustrates a composite temperature sensor according to a second modification example of the second embodiment. A composite temperature sensor 70 of the second modification example is different from those of the second embodiment and the first modification example in that the composite temperature sensor 70 can output signals corresponding to temperatures of a plurality of positions of the fixing belt 38. The description of the second modification example that is the same as those of the second embodiment and the first modification example will be omitted.

The composite temperature sensor 70 can output signals corresponding to temperatures of temperature detection positions P1 to P9 on the outer peripheral surface of the fixing belt 38. The temperature detection positions P1 to P9 are disposed side by side in the Y direction.

The composite temperature sensor 70 includes a guide member 80, a condenser lens 71, and a temperature detection element 72.

The guide member 80 stretches in the Y direction along the fixing belt 38. The guide member 80 is disposed so that the end surface thereof in the +X direction faces the outer peripheral surface of the fixing belt 38. Mirror surfaces M1 to M9 are formed on the end surface of the guide member 80 in the +X direction corresponding to the temperature detection positions P1 to P9 of the fixing belt 38. The positions of the mirror surfaces M1 to M9 in the Y direction are the same as the positions of the temperature detection positions P1 to P9 in the Y direction, respectively. The mirror surfaces M1 to M9 reflect infrared rays radiated from the temperature detection positions P1 to P9 of the fixing belt 38 toward the condenser lens 71. The end surface of the guide member 80 in the +X direction is formed in a stepped shape in which the mirror surfaces M1 to M9 are formed as stepped portions.

The condenser lens 71 condenses the infrared rays incident from the guide member 80 toward the temperature detection element 72. The temperature detection element 72 includes a plurality of light receiving elements corresponding to the temperature detection positions P1 to P9 of the fixing belt 38. The plurality of light receiving elements output signals corresponding to the intensity of the incident infrared rays. The control unit 6 detects the temperatures of the temperature detection positions P1 to P9 of the fixing belt 38 based on the output signals of the plurality of light receiving elements.

The composite temperature sensor 70 is formed by integrating the middle temperature sensor 39*m*, the first end temperature sensor 39*na*, and the second end temperature sensor 39*nb*.

The temperature detection position P5 is a position in the middle of the fixing belt 38 in the Y direction. The composite temperature sensor 70 can output a signal corresponding to a temperature of the temperature detection position P5 of the fixing belt 38 by the mirror surface M5 of the guide member 80. That is, the composite temperature sensor 70 has a function of the middle temperature sensor 39*m*.

The temperature detection positions P6 to P9 are positions in the +Y direction from the center of the fixing belt 38 in the Y direction, and include positions of the ends in the +Y direction. The composite temperature sensor 70 can output signals corresponding to temperatures of the temperature detection positions P6 to P9 of the fixing belt 38 by the mirror surfaces M6 to M9 of the guide member 80. That is, the composite temperature sensor 70 has a function of the first end temperature sensor 39*na*. The first end temperature sensor 39*na* can output the signals corresponding to the temperatures of the plurality of temperature detection positions P6 to P9 in the +Y direction from the center of the fixing belt 38 in the Y direction.

The temperature detection positions P1 to P4 are positions in the −Y direction from the center of the fixing belt 38 in the Y direction, and include positions of the ends in the −Y direction. The composite temperature sensor 70 can output signals corresponding to temperatures of the temperature detection positions P1 to P4 of the fixing belt 38 by the mirror surfaces M1 to M4 of the guide member 80. That is, the composite temperature sensor 70 has a function of the second end temperature sensor 39*nb*. The second end temperature sensor 39*nb* can output the signals corresponding to the temperatures of the plurality of temperature detection positions P1 to P4 in the −Y direction from the center of the fixing belt 38 in the Y direction.

The sheets S of various sizes are passed through the fixing device. When the width of the sheet S in the Y direction is small, a distance from the end of the sheet S in the +Y direction to the end of the fixing belt 38 in the +Y direction becomes long. Even when the first temperature of the end of the fixing belt 38 in the +Y direction exceeds the predetermined temperature Td, there is a possibility that the high temperature offset does not occur at the end of the sheet passing region in the +Y direction.

The control unit 6 detects the temperature of the fixing belt 38 at a position closest to the +Y direction from the end of the sheet S in the +Y direction. In the example of FIG. 12, the end of the sheet S in the +Y direction is disposed between P6 and P7. The control unit 6 detects the temperature of the P7 at a position closest to the +Y direction from the end of the sheet S in the +Y direction. When the temperature of P7 is equal to or higher than the predetermined temperature Td, there is a high possibility that the high temperature offset occurs at the end of the sheet passing region of the fixing belt 38 in the +Y direction. In this case, as illustrated in FIG. 9, the control unit 6 moves the first movement portion 50*a* so that the first end 59*a* is located at the first position. The first position is a position away by the predetermined distance E in the −Y direction from the end of the sheet S in the +Y direction. On the other hand, when the temperature of P7 is lower than the predetermined temperature Td, there is a low possibility that the high temperature offset occurs at the end of the sheet passing region of the fixing belt 38 in the +Y direction. In this case, as illustrated in FIG. 10, the control unit 6 moves the first movement portion 50*a* so that the first end 59*a* is disposed at the end of the sheet S in the +Y direction. Thus, even when the sheets S of various sizes are passed through, it is possible not only to accurately determine whether or not the high temperature offset occurs, but also to move the first movement portion 50*a*.

As described above, the heating device of the second modification example includes the composite temperature sensor 70 in which the first end temperature sensor 39*na* and the second end temperature sensor 39*nb* are integrated. The first end temperature sensor 39*na* can output the signals corresponding to the temperatures of the plurality of positions in the +Y direction from the center of the fixing belt 38 in the Y direction. The second end temperature sensor 39*nb* can output the signals corresponding to the temperatures of the plurality of positions in the −Y direction from the center of the fixing belt 38 in the Y direction.

Accordingly, even when the sheets S of various sizes are passed through, it is possible not only to accurately determine whether or not the high temperature offset occurs, but also to move the first movement portion 50*a*. Therefore, the high temperature offset occurring at the end of the sheet passing region A1 of the fixing belt 38 in the Y direction is suppressed. The sheet passing region A1 of the fixing belt 38 is maintained within the fixing temperature range.

In the second modification example, the control unit 6 detects the temperature of the fixing belt 38 at the position closest to the +Y direction from the end of the sheet S in the +Y direction. On the other hand, the control unit 6 may detect the temperature of the fixing belt 38 at a predetermined position set in advance corresponding to the width of the sheet S in the Y direction. Thus, it is possible to accurately determine whether or not the high temperature offset occurs at the end of the sheet passing region of the fixing belt 38 in the Y direction.

The image processing apparatus according to the embodiment is the image forming apparatus 1 and a heating device is the fixing device 30. On the other hand, the image processing apparatus may be a decoloring apparatus and the heating device may be a decoloring unit. The decoloring apparatus performs a process of decoloring (erasing) an image formed on a sheet by decoloring toner. The decoloring unit heats a decoloring toner image formed on a sheet passing through a nip for the decoloring. The decoloring unit is cooled by the cooling device 40 similar to that of the embodiment. Thus, a sheet non-passing region of the rotator is efficiently cooled.

According to at least one of the above-described embodiments, the first introduction duct 54*a* stretching in the +Y direction as approaching the rotation axis C of the fixing belt 38 is included. Thus, the sheet non-passing region A2 of the fixing belt 38 is efficiently cooled.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image processing apparatus comprising:

an image forming device;

a heating device configured to fix a toner image formed on a sheet by the image forming device, the heating device including:

a rotator having, inside thereof, a heater configured to generate heat for fixing the toner image;

a fan configured to generate an airflow towards a surface of the rotator;

an introduction duct positioned with respect to the fan and shaped such that the airflow generated by the fan is directed towards and is incident on a first end portion of the rotator in an axial direction of the rotator;

a cooling duct extending between the introduction duct and a first end of the rotator in the axial direction, and facing the first end portion of the rotator, the cooling duct including a plurality of duct portions extending along the rotational axis of the rotator, one of the duct portions disposed closest to the first end of the rotator being stationary; and a movement mechanism configured to move the fan, the introduction duct, and at least one of the duct portions of the cooling duct along the rotational axis of the rotator;

a temperature sensor configured to detect a temperature at the first end portion of the rotator; and a controller configured to control a movement of the movement mechanism based on a temperature detected by the temperature sensor.

2. The image processing apparatus according to claim 1, wherein the controller is configured to control the movement mechanism such that the airflow is not incident on a region of the rotator that is in contact with the sheet.

3. The image processing apparatus according to claim 1, wherein the controller is configured to determine a width of the sheet in the axial direction, and turn on the fan upon determining that the width of the sheet is less than a predetermined value.

4. The image processing apparatus according to claim 3, wherein the controller is further configured to control the movement mechanism upon determining that the width of the sheet is less than the predetermined value.

5. The image processing apparatus according to claim 1, wherein the controller is configured to determine the number of sheets continuously passing through the heating device, and turn on the fan upon determining that the number of sheets is greater than a predetermined value.

6. The image processing apparatus according to claim 5, wherein the controller is further configured to control the movement mechanism upon determining that the number of sheets is greater than the predetermined value.

7. The image processing apparatus according to claim 1, wherein the controller is further configured to turn on the fan upon detecting that a temperature sensed by the temperature sensor reaches a predetermined temperature.

8. The image processing apparatus according to claim 1, wherein the controller is further configured to control the movement mechanism such that the cooling duct is in a first positional state when a temperature detected by the temperature sensor is higher than a predetermined temperature and in a second positional state different from the first positional state when the temperature detected by the temperature sensor is lower than the predetermined temperature.

9. The image processing apparatus according to claim 8, wherein the cooling duct in the first positional state is more extended in the axial direction than the cooling duct in the second positional state.

10. The image processing apparatus according to claim 1, wherein the plurality of duct portions include three or more duct portions, and two or more of the duct portions other than one of the duct portions disposed closest to the first end of the rotator are movable along the rotational axis of the rotator.

11. The image processing apparatus according to claim 1, wherein the movement mechanism moves the introduction duct, the movement of the introduction duct causing a movement of a first one of the duct portions, and the movement of the first one of the duct portion causing a movement of a second one of the duct portions.

12. The image processing apparatus according to claim 1, wherein the plurality of duct portions is arranged such that a distance to the surface of the rotator from the duct portions increases towards the first end of the rotator.

13. The image processing apparatus according to claim 1, wherein the end of the introduction duct is positioned closer to the surface of the rotator than any of the duct portions of the cooling duct.

14. The image processing apparatus according to claim 1, wherein the heating device further comprises:

a second fan configured to generate a second airflow towards a surface of the rotator;

a second introduction duct positioned with respect to the second fan and shaped such that the second airflow generated by the second fan is directed towards and is incident on a second end portion of the rotator in the axial direction; and a second cooling duct extending between the second introduction duct and a second end of the rotator in the axial direction, and facing the second end portion of the rotator, the second cooling duct including a plurality of second duct portions extending along the rotational axis of the rotator, wherein the movement mechanism is further configured to move the second fan, the second introduction duct, and at least one of the second duct portions of the second cooling duct along the rotational axis of the rotator.

15. The image processing apparatus according to claim 14, wherein the movement mechanism causes independent move of the introduction duct from move of the second introduction duct.

16. The image processing apparatus according to claim 15, further comprises:

a second temperature sensor configured to detect a temperature at the second end portion of the rotator, wherein the controller is further configured to control a movement of the movement mechanism based on a temperature detected by the second temperature sensor.

17. The image processing apparatus according to claim 16, wherein the controller causes a movement of the cooling duct based on the temperature detected by the temperature sensor and a movement of the second cooling duct based on the temperature detected by the second temperature sensor.

18. The image processing apparatus according to claim 14, wherein the temperature sensor includes:

a lens;

a temperature detector element configured to perform temperature detection based on infrared rays from the lens; and a guide member having a first reflection surface configured to direct infrared rays from the first end portion of the rotator to the lens and a second reflection surface configured to direct infrared rays from the second end portion of the rotator to the lens.

19. An image processing apparatus comprising:

an image forming device;

a heating device configured to fix a toner image formed on a sheet by the image forming device, the heating device including:

a rotator having, inside thereof, a heater configured to generate heat for fixing the toner image;

a fan configured to generate an airflow towards a surface of the rotator;

an introduction duct positioned with respect to the fan and shaped such that the airflow generated by the fan is directed towards and is incident on a first end portion of the rotator in an axial direction of the rotator;

a cooling duct extending between the introduction duct and a first end of the rotator in the axial direction, and facing the first end portion of the rotator, the cooling duct including a plurality of duct portions extending along the rotational axis of the rotator;

a second fan configured to generate a second airflow towards a surface of the rotator;

a second introduction duct positioned with respect to the second fan and shaped such that the second airflow generated by the second fan is directed towards and is incident on a second end portion of the rotator in the axial direction;

a second cooling duct extending between the second introduction duct and a second end of the rotator in the axial direction, and facing the second end portion of the rotator, the second cooling duct including a plurality of second duct portions extending along the rotational axis of the rotator; and a movement mechanism configured to move the fan, the second fan, the introduction duct, the second introduction duct, at least one of the duct portions of the cooling duct, and at least one of the second duct portions of the second cooling duct along the rotational axis of the rotator;

a temperature sensor configured to detect a temperature at the first end portion of the rotator, the temperature sensor including:

a lens;

a temperature detector element configured to perform temperature detection based on infrared rays from the lens; and a guide member having a first reflection surface configured to direct infrared rays from the first end portion of the rotator to the lens and a second reflection surface configured to direct infrared rays from the second end portion of the rotator to the lens; and a controller configured to control a movement of the movement mechanism based on a temperature detected by the temperature sensor.

20. A heating device comprising:

a rotator having, inside thereof, a heater configured to generate heat for fixing a toner image;

a fan configured to generate an airflow towards a surface of the rotator;

an introduction duct positioned with respect to the fan and shaped such that the airflow generated by the fan is directed towards and is incident on a first end portion of the rotator in an axial direction of the rotator;

a cooling duct extending between the introduction duct and a first end of the rotator in the axial direction, and facing the first end portion of the rotator, the cooling duct including a plurality of duct portions extending along the rotational axis of the rotator; and a movement mechanism configured to move the fan, the introduction duct, and at least one of the duct portions of the cooling duct along the rotational axis of the rotator, wherein the plurality of duct portions include three or more duct portions, and two or more of the duct portions other than one of the duct portions disposed closest to the first end of the rotator are movable along the rotational axis of the rotator.

* * * * *